US007010257B2

(12) United States Patent
Someya et al.

(10) Patent No.: US 7,010,257 B2
(45) Date of Patent: Mar. 7, 2006

(54) METHOD OF FIXING TONER ON RECORDING MEDIUM

(75) Inventors: Yukimichi Someya, Saitama (JP); Takashi Fujita, Kanagawa (JP); Hisashi Kikuchi, Kanagawa (JP); Katsuhiro Echigo, Saitama (JP); Shigeo Kurotaka, Kanagawa (JP); Toshihiko Baba, Tokyo (JP); Hiroyuki Kunii, Kanagawa (JP); Atsushi Nakafuji, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/008,204

(22) Filed: Dec. 10, 2004

(65) Prior Publication Data

US 2005/0158088 A1 Jul. 21, 2005

(30) Foreign Application Priority Data

Dec. 12, 2003 (JP) ..... 2003-414983

(51) Int. Cl.
*G03G 15/20* (2006.01)

(52) U.S. Cl. ..... 399/328; 399/69

(58) Field of Classification Search ..... 399/328
See application file for complete search history.

(56) References Cited

U.S. PATENT DOCUMENTS 5,701,554 A * 12/1997 Tanaka et al. ..... 399/69

FOREIGN PATENT DOCUMENTS

| | | |
|---|---|---|
| JP | 11-282307 | 10/1999 |
| JP | 2002-23538 | 1/2002 |
| JP | 2002-162773 | 6/2002 |
| JP | 2003-156959 | 5/2003 |
| JP | 2004-145260 | 5/2004 |

* cited by examiner

*Primary Examiner*—Quana Grainger
(74) *Attorney, Agent, or Firm*—Oblon, Spivak, McClelland, Maier & Neustadt, P.C.

(57) ABSTRACT

The fixing unit satisfies following three conditions. That is, (1) $2.4\times10^3\times d/(TC\times t)<T_0$, where d is a thickness of the unfixed toner layer in meters, TC is a thermal conductivity of toner in W/mK, and t is the fixing time in seconds; (2) a temperature $T_{top}$ of a topmost layer of the toner layer is not greater than the minimum temperature $T_{OFF}$ at which the hot offset of the surface of the first fixing member occurs when the fixing time is set to 1 seconds; and (3) a temperature $T_{bot}$ of a bottommost layer of the toner layer that is in contact with the recording medium is not less than the lower limit temperature $T_{MIN}$ for fixing of the surface of the first fixing member when the fixing time is set to 1 second.

14 Claims, 6 Drawing Sheets

METHOD OF FIXING TONER ON RECORDING MEDIUM

CROSS-REFERENCE TO RELATED APPLICATIONS

The present document incorporates by reference the entire contents of Japanese priority document, 2003-414983 filed in Japan on Dec. 12, 2003.

BACKGROUND OF THE INVENTION

1) Field of the Invention

The present invention relates to a technology for fixing a toner image on a recording medium by holding the recording medium between a nip section formed between two bodies that move relatively to each other.

2) Description of the Related Art

In an electrophotographic or an electrostatic image forming apparatus, normally an electrostatic latent image is formed on an image carrier such as a photosensitive drum or a photosensitive belt according to image information. A toner image is formed by allowing toner, which is charged, to adhere to the electrostatic latent image. The toner image is then fixed on a recording medium by the application of heat or pressure.

A roller fixing method in which a pair of rollers which are in contact with each other as fixing members has been known as a method of fixing a toner image on the recording medium. In the roller fixing method, one of the rollers is used as a heating roller and the other roller is used as a pressurizing roller. A fixing nip that holds and carries the recording medium is formed at a position where the two rollers come in contact with each other. Heating and pressurizing is performed while the recording medium passes through the fixing nip and toner that is not fixed is melted and pressed on the recording medium, thereby getting the toner fixed on the recording medium.

Apart from the roller fixing method, a belt fixing method in which any one or both of the heating roller and the pressurizing roller are substituted by a belt is know (refer to Japanese Patent Application Laid-open Publication No. H11-282307).

However, in these fixing methods, due to the direct contact of the unfixed toner carried on the recording medium with a fixing member such as the roller and the belt, a hot offset tends to occur easily. The hot offset is a phenomenon in which a part of the unfixed toner is reversed back to the fixing member and adhered to it while fixing. When the temperature of the fixing member is high, there is a reduction in cohesive force of the melted toner, thereby leading to easy occurrence of the hot offset.

On the other hand, it is desirable to reduce power consumption to save energy. The following are methods that allow reduction in the power consumption. (1) Stop power supply to the fixing unit when the fixing unit is not in use, and (2) Perform fixing at a low temperature.

Applicants of the present invention have proposed a toner that can be fixed at a low temperature in Japanese Patent Application Laid-open Publication No. 2002-162773. Moreover, a structure that enables to reduce an amount of electricity required during a waiting time starting from the passing of electricity until image forming (warming up time of the unit) to minimum extent has been proposed in Japanese Patent Application Laid-open Publication No. 2003-156959.

The energy conservation has become an important issue since ecology has been drawing more and more attention in recent years. Therefore, an accomplishment of the energy conservation has been sought after.

Further, a technology of fixing an image on a large amount of recording media at a speed higher than that achieved so far, without increasing the amount of electric power used by the fixing unit, has been sought after.

SUMMARY OF THE INVENTION

It is an object of the present invention to provide a fixing unit having lower poser consumption.

A fixing unit according to an aspect of the present invention includes a first fixing member that faces a surface of a recording medium on which an unfixed toner layer is held; a second fixing member that is in a pressurized contact with the first fixing member so as to form a fixing nip theirbetween; and a heating unit that heats the unfixed toner layer from a side of the first fixing member so as to fix the unfixed toner layer on the recording medium. If a difference between a lower limit temperature $T_{MIN}$ for fixing of a surface of the first fixing member that satisfies a fixity and a minimum temperature $T_{OFF}$ of the surface of the first fixing member at which a hot offset occurs at an exit of the fixing nip when a fixing time, in seconds, that is obtained by dividing a width, in meters, of the fixing nip by a velocity, in m/s, of carrying the recording medium through the fixing nip is set to 1 second is let to be $T_0$, following conditions are satisfied:

(1) $2.4\times10^3\times d/(TC\times t)<T_0$, where d is a thickness of the unfixed toner layer in meters, TC is a thermal conductivity of toner in W/mK, and t is the fixing time in seconds, (2) a temperature $T_{top}$ of a topmost layer of the toner layer is not greater than the minimum temperature $T_{OFF}$ at which the hot offset of the surface of the first fixing member occurs when the fixing time is set to 1 seconds, and (3) a temperature $T_{bot}$ of a bottommost layer of the toner layer that is in contact with the recording medium is not less than the lower limit temperature $T_{MIN}$ for fixing of the surface of the first fixing member when the fixing time is set to 1 second.

A method of fixing toner on a recording medium according to another aspect of the present invention includes using the above fixing unit according to the present invention.

An image forming apparatus according to another aspect of the present invention includes the above fixing unit according to the present invention.

The other objects, features, and advantages of the present invention are specifically set forth in or will become apparent from the following detailed description of the invention when read in conjunction with the accompanying drawings.

DETAILED DESCRIPTION

Inventors of the present invention made the present invention by knowledge gained by experiments described below.

First Experiment

To start with, a first experiment, which shows that as a time for fixing unfixed toner on a recording medium, becomes short, there is an increase in a lower limit temperature $T_{MIN}$ for fixing to satisfy fixity, is described below.

Figure 1:
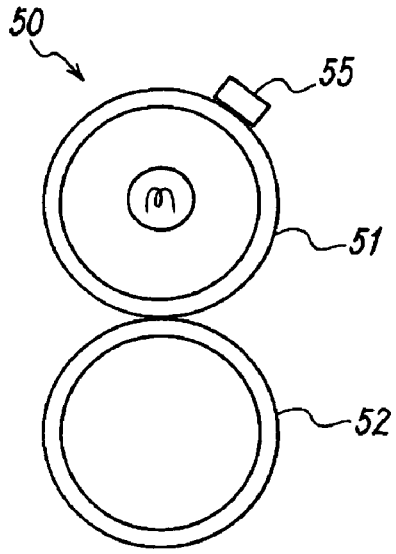
FIG. 1 is a schematic diagram of a fixing unit according to a first embodiment of the present invention.

FIG. 1 is a schematic diagram of a fixing unit used in the first experiment. A fixing unit 50, as shown in the diagram, includes a heating roller 51 and a pressurizing roller 52. The heating roller 51 is a first fixing member that has a heat source inside it. The pressurizing roller 52 is a second fixing member that is in contact with the heating roller 51. At a position where the heating roller 51 and the pressurizing roller 52 are in contact, a fixing nip that can hold and carry a recording paper, which is a recording medium, is formed. When the recording medium passes through the fixing nip, the fixing nip is heated. Heat is transferred from a top layer of the toner that is contact with the heating roller to the recording paper. Unfixed toner is melted on the recording medium and is pressed into fibers of the recording paper. Thus, the unfixed toner is fixed on the recording paper. Conditions for the first experiment are as shown in table 1.

TABLE 1

| ITEM | UNIT | CONDITION FOR EXPERIMENT |
|---|---|---|
| Thickness of layer of unfixed toner | [μm] | 5, 10, 20 |
| Thermal conductivity of toner | W/mK | 0.061 |
| Paper size | | A4 |
| Paper thickness | [μm] | 92 |
| Thermal conductivity of recording paper | W/mK | 0.094 |
| Image | | full surface beta image |
| Outer diameter of the heating roller 51 | mm | ψ40 |
| Outer diameter of pressurizing roller | mm | ψ40 |
| Average load | kPa | 290 |

Figure 2:
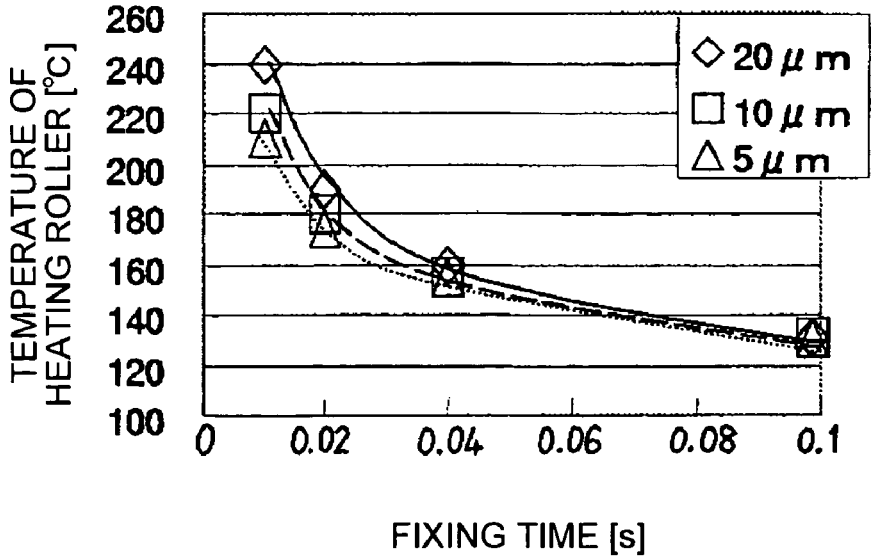
FIG. 2 is a graph of fixing time versus temperature of heating roller.

FIG. 2 is a graph of a time required for fixing the unfixed toner on the recording medium, in other words, time for passing the recording medium through the fixing nip (width of fixing nip [mm]/speed of the recording medium P [mm/s]) (hereinafter, "fixing time") versus a lower limit temperature $T_{MIN}$ for fixing of a surface of the heating roller 51 that satisfies fixity. It can be seen, that as the fixing time becomes short, a surface temperature of the heating roller 51 has to be set higher. For example, if a sample having a thickness of an unfixed toner layer 20 μm is used, the setting is required to be done such that when the fixing time is 0.1 s, the temperature becomes 240° C. and when the fixing time is 0.01 s, the temperature becomes not less than 130° C. The difference in a set temperature practically goes up to 110° C.

The following is a description of a relationship between the thickness of the unfixed toner layer (hereinafter, "toner layer thickness"), and the lower limit temperature $T_{MIN}$ for fixing based on the results of the first experiment. When the fixing time is set to 0.1 s, to fix an unfixed toner layer of 5 μm thickness, the temperature is required to be set to not less than 130° C. and to fix an unfixed toner layer of 20 μm thickness; the temperature is required to be set to not less than 130° C. It was observed that at this time there was no difference in the temperature and the same temperature was attained irrespective of the toner layer thickness. On the other hand, when the fixing time is set to 0.02 s, to fix the unfixed toner layer of 5 μm thickness, the temperature is required to be set to not less than 175° C. and to fix the unfixed toner layer of 20 μm thickness; the temperature is required to be set to not less than 190° C. It was observed that at this time the temperature difference was 15° C. and the lower limit temperature $T_{MIN}$ for fixing changed according to the toner layer thickness. This suggests that the temperature is not uniform in a direction of thickness of the unfixed toner layer.

If the fixing time is set sufficiently long, the heat is transmitted sufficiently from the surface of the heating roller to the top layer of the toner up to a bottom layer. Also, a toner top layer temperature $T_{top}$ and a temperature of a bottom layer of the toner that comes in contact with the recording paper i.e., a toner bottom layer temperature $T_{bot}$ becomes the same. Irrespective of the toner thickness, a time required for the toner bottom layer temperature $T_{bot}$, which is a temperature of the toner bottom layer that comes in contact with the recording paper, to be the same as the temperature of the top layer of the heating roller was found out. It was observed that when the fixing time was let to be 1 s, irrespective of the toner layer thickness, the toner bottom layer temperature $T_{bot}$ was the same as the temperature of the surface of the heating roller. This means that if the fixing time is set to 1 s, this fixing time is sufficient to transfer uniformly the temperature of the surface of the heating roller 51 in the direction of thickness. In the first experiment, when the fixing time was set to 1 s, the lower limit temperature $T_{MIN}$ for fixing became 110° C. irrespective of thickness of the unfixed toner layer.

Moreover, when a similar experiment was performed by changing the toner, it was confirmed that the result obtained in FIG. 2 and similar trend can be achieved. When the fixing time was set to 1 s, the toner bottom layer temperature $T_{bot}$ became same as the temperature of the surface of the heating roller irrespective of the toner layer thickness.

Second Experiment

The following is a description of a second experiment, which shows that when the fixing time is shortened, the power consumption for fixing per paper is reduced.

The second experiment was performed by changing the fixing time and finding the power consumption for each fixing time. The temperature of the surface of the heating roller 51 was set to the lower limit fixing temperature $T_{MIN}$ for fixing obtained from the graph in FIG. 2. Output speed of the recording paper was set to 45 papers per minute and the experiment was performed with a condition of continuous output. Other conditions for the experiment were the same as those for the first experiment.

Figure 3:
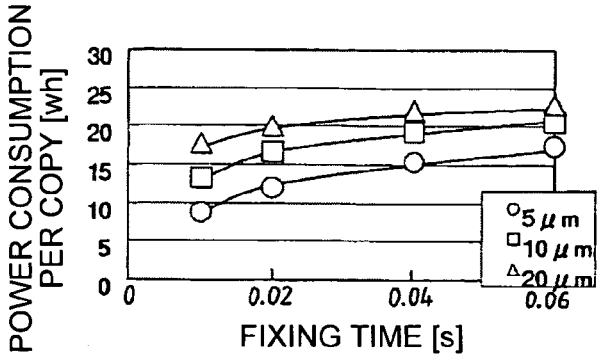
FIG. 3 is a graph of fixing time versus power consumption per copy.

FIG. 3 is a graph of the power consumption for fixing per paper of A4 size versus the fixing time. A value of the power consumption in this case is obtained by converting the power consumption obtained by the experiment to power consumption per paper. It can be seen from FIG. 3 that with the fixing timing becoming shorter, there is a reduction in the power consumption per paper. For example, in a case of the toner layer thickness of 20 $\mu$m, for the fixing time 0.06 s, the power consumption was 22.9 wh and for the fixing time 0.01 s, the power consumption was 17.8 wh. By changing the fixing time from 0.06 s to 0.01 s, 5.1 wh of power could be reduced per paper. This is considered to be due to the fact that with shortening of the fixing time, there is a difference in temperature between the toner layer and the direction of thickness of the recording paper and this does not impart excessive heat to the recording paper.

The following is a description of a relationship observed between the toner layer thickness and the power consumption. When the fixing time was 0.06 s, with the toner layer thickness of 20 $\mu$m, the power consumption was 22.9 wh and with the toner layer thickness of 5 $\mu$m, the power consumption was 17.4 wh. By reducing the toner layer thickness from 20 $\mu$m to 5 $\mu$m, the power consumption could be reduced by 5.5 wh. It was found that the reduction in the power consumption with the reduction in the toner layer thickness is even more when the fixing time is shortened.

From the second experiment, it was proved that (1) shortening the fixing time and (2) reducing the thickness of the toner layer are effective in reducing the power consumption. According to the first experiment, with the shortening of the fixing time, the lower limit temperature $T_{MIN}$ for fixing rises up and it is necessary to raise the set temperature of the heating roller 51. However, it was revealed that as compared to the reduction in the power consumption due to rise in the temperature, the reduction in the power consumption due to (1) above, i.e. due to shortening of the fixing time, and due to (2) above, i.e. due to reduction in the toner layer thickness is more.

The following is a description of a result that reveals that with the shortening of the fixing time there is a greater temperature distribution in the direction of thickness of the toner layers.

According to the first and the second experiments, it was observed that when the fixing time is shortened, there is a temperature distribution in the direction of thickness of the recording paper and the toner layer during the fixing time. Therefore, the inventors of the present invention examined the temperature distribution in the direction of thickness of the recording paper and the toner layer during fixing by using a heat transfer calculation method. In this case, the heat transfer calculation method is a method for calculating thermal conduction by using the thermal conductivity obtained by a second part of a method for measuring heat resistance and thermal conductivity of a heat insulating material according to JIS A1412-2: a heat flow meter method (HFM method). The thermal conduction is calculated by a finite differential equation that is obtained from a general equation of the thermal conduction.

A basic equation for calculating the thermal conduction is equation 1 given below, which is a one-dimensional thermal conduction equation.

$$\delta T/\delta t=\lambda/(\rho C)\cdot(\delta 2/\delta x2)\cdot T \quad (1)$$

(where, T is temperature, t is time, $\lambda$ is thermal conductivity, $\rho$ is density, C is specific heat, and x is distance).

For each material of thermal conduction calculation materials, temperature obtained from each sensor is set as an initial temperature and equation 1 above is solved. The equation can be solved by dividing the material by a mesh and by applying a method such as a finite difference method and a finite element method. The calculation was with the conditions of the first and the second experiments.

Figure 4:
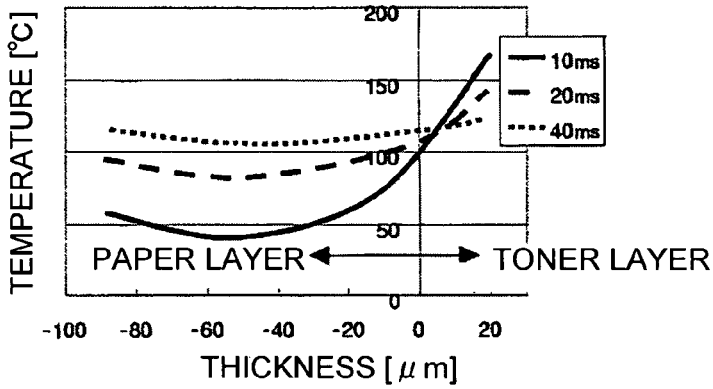
FIG. 4 is a graph of a temperature distribution in a direction of thickness of a recording paper and toner layer.

FIG. 4 is a graph of a temperature obtained by the calculation of the heat transferred versus the direction of the thickness of the recording paper and the toner, when the thickness of the unfixed layer is 20 $\mu$m. From the graph, it can be seen that when the fixing time was 0.04 s, the temperature in the direction of thickness of the toner layer and the recording medium was almost the same. On the other hand, when the fixing time was 0.01 s, the toner top layer temperature $T_{top}$ was 176° C. and the toner bottom layer temperature $T_{bot}$ was 99° C. The temperature at a distance of 50 $\mu$m towards the direction of thickness of the recording paper from an interface between the toner layer and the recording paper was 43° C.

The difference in temperature in the direction of thickness of the toner layer was up to 77° C. maximum and the difference between the minimum temperature of the paper and the toner top layer temperature was up to 133° C. In other words, it was supported by the calculation of conduction that with the decrease in the fixing time, there is an increase in a temperature gradient in the direction of the thickness of the recording medium and the toner layer.

Integral values of these temperature distribution curves are shown in Table 2. The integral value is equivalent to the amount of heat energy that is used while fixing the toner on the recording paper. The integral value is calculated from a rise in temperature of one recording paper of A4 size that passes through the nip, from 25° C., which is a room temperature.

TABLE 2

| Fixing time(s) | Integral value of temperature distribution (J) |
|---|---|
| 0.01 | 309 |
| 0.02 | 459 |
| 0.04 | 611 |

From table 2, an integral value of a temperature distribution curve at the fixing time 0.01 s became 309 J and an integral value of a temperature distribution curve at the fixing time 0.04 became 611 J. It was observed that shorter was the fixing time, less was the amount of heat energy used, it was proved to be useful for energy conservation. This is considered to be due to the fact that no unnecessary heat energy is imparted to the recording paper. However, if the fixing time is shortened, the temperature of the heating roller is to be set to a higher temperature as compared to that in a case of longer fixing time, as obtained in the first experiment. If the temperature becomes high, it may lead to an occurrence of the so called hot offset in which the toner is adhered to the heating roller 51 due to a reduction in cohesive force.

Third Experiment

The inventors of the present invention examined a minimum temperature $T_{OFF}$ at which the hot offset occurs with respect to the fixing time, to study the hot offset problem.

The conditions for the third experiment were the same as that for the first experiment except for using 20 μm thick unfixed toner layer.

Figure 5:
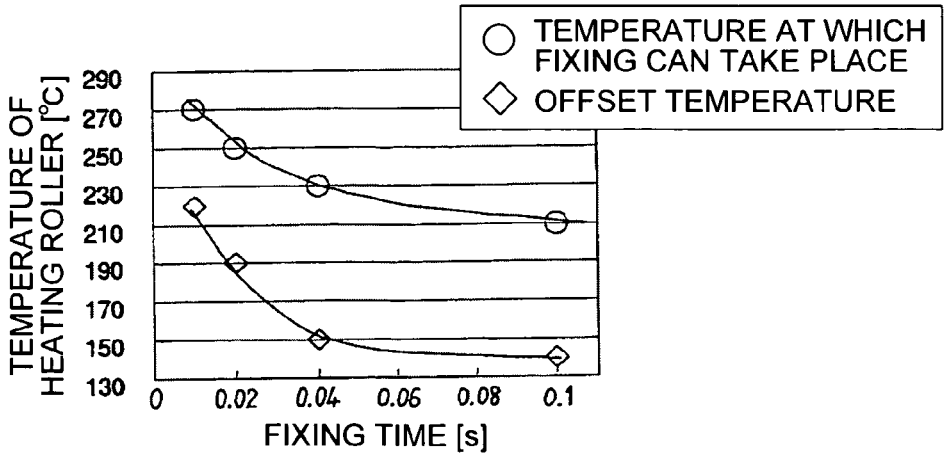
FIG. 5 is a graph of fixing time versus temperature of heating roller.

FIG. 5 is a graph of the minimum temperature $T_{OFF}$ at which the hot offset occurs, versus the fixing time. In this diagram, the graph is drawn by including the curve for the lower limit temperature for fixing obtained in FIG. 2. From FIG. 5, it can be seen that with the shortening of the fixing time, there is a rise in the minimum temperature $T_{OFF}$ at which the hot offset occurs. For example, when the fixing time was 0.1 s, an offset temperature was 210° C., when the fixing time was 0.01 second, the offset temperature was 270° C. In other words, due to a change in the fixing time from 0.1 s to 0.01 s, there is a temperature rise of 60° C. approximately. It was observed that the temperature at which the hot offset occurs varied according to the fixing time.

Moreover, it was observed that as the fixing time became shorter, a difference in the minimum temperature $T_{OFF}$ at which the hot offset occurs and the lower limit temperature $T_{MIN}$ for fixing was lesser. For example, when the fixing time was 0.1 s, the difference between the $T_{OFF}$ and the $T_{MIN}$ was approximately 70° C., whereas when the fixing time was 0.01 s, the difference between the $T_{OFF}$ and the $T_{MIN}$ was 50° C. This means that as the fixing time becomes shorter, a range of temperature in which the fixing is possible becomes narrower.

The minimum temperature $T_{OFF}$ at which the hot offset occurs when the fixing time was set to 1 s (refer to the first experiment) at which the toner bottom layer temperature $T_{bot}$ of the bottom layer of the toner that comes in contact with the recording paper and the temperature of the surface of the hot roller were the same irrespective of the toner layer thickness, was 170° C.

When the fixing time was let to be 1 s, the lower limit temperature for fixing was 110° C. as mentioned. From this, attention of the inventors of the present invention was drawn to a point that if the toner bottom layer temperature $T_{bot}$ of the toner bottom layer that comes in contact with the recording paper, is set to be not less than the lower limit temperature $T_{MIN}$ for fixing when the fixing time was set to 1 s, the fixity can be satisfied even if the fixing time is shortened. In the third experiment, if the toner bottom layer temperature $T_{bot}$, which is a temperature of the toner layer that comes in contact with the recording paper, is set to 110° C., the fixity can be satisfied even if the fixing time is shortened.

Moreover, the inventors of the present invention realized that if the toner bottom layer temperature is set to be lower than the minimum temperature $T_{OFF}$ at which the hot offset occurs when the fixing time is set to 1 s, the hot offset does not occur even if the fixing time is shortened. In the third experiment, if the toner top layer temperature $T_{top}$ is set to a temperature less than 170° D, the occurrence of the hot offset can be prevented even when the fixing time is shortened.

When the fixing time was let to be 1 s, the difference in the minimum temperature $T_{OFF}$ at which the hot offset occurs and the lower limit temperature $T_{MIN}$ for fixing was 60° C. This difference in the temperature was the same value independent of film thickness. Practically, it has already been confirmed by the equation for calculating the thermal conduction that at this time, the toner top layer temperature $T_{top}$ and the toner bottom layer temperature $T_{bot}$ were almost the same as the temperature of the surface of the heating roller. When an top layer of the recording paper was measured by a radiation thermometer (KEYENCE VK8500) immediately after the passing of the recording paper through a fixing nip A, it was confirmed that a temperature almost same as the calculated value obtained by the equation for calculating the thermal conduction.

The following is a description of a result upon calculating thickness of a toner layer for which the temperature difference occurs with respect to the fixing time by using the equation for calculating the thermal conduction.

The calculation was performed with the conditions for the first experiment. The thickness of the toner layer in this case is a distance from the toner top layer in a downward direction towards layers below the top layer. The results are shown in table 3.

TABLE 3

| | Thickness of toner layer μm | | |
|---|---|---|---|
| Fixing time (s) | Temperature difference of toner layer 20 (° C.) | Temperature difference of toner layer 30 (° C.) | Temperature difference of toner layer 40 (° C.) |
| 0.01 | 6 | 8 | 12 |
| 0.02 | 10 | 15 | 20 |
| 0.03 | 14 | 20 | 26 |
| 0.04 | 20 | 28 | 38 |
| 0.10 | 45 | 73 | 97 |

Figure 6:
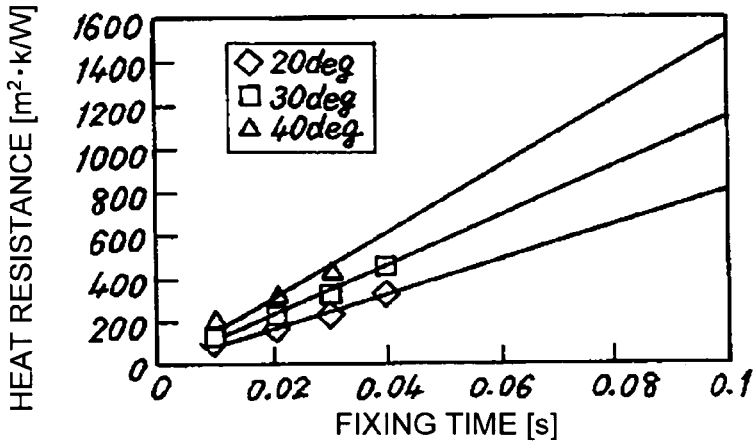
FIG. 6 is a graph of the fixing time versus heat resistance.

FIG. 6 is a graph of the fixing time [s] versus heat resistance [$m^2K/W$] which is a value obtained by dividing the thickness [m] of the toner by the thermal conductivity [W/mK] of the toner, based on the results shown in table 3. From this graph, it can be seen that the fixing time [s] and the heat resistance [$m^2K/W$] are proportional to each other.

Figure 7:
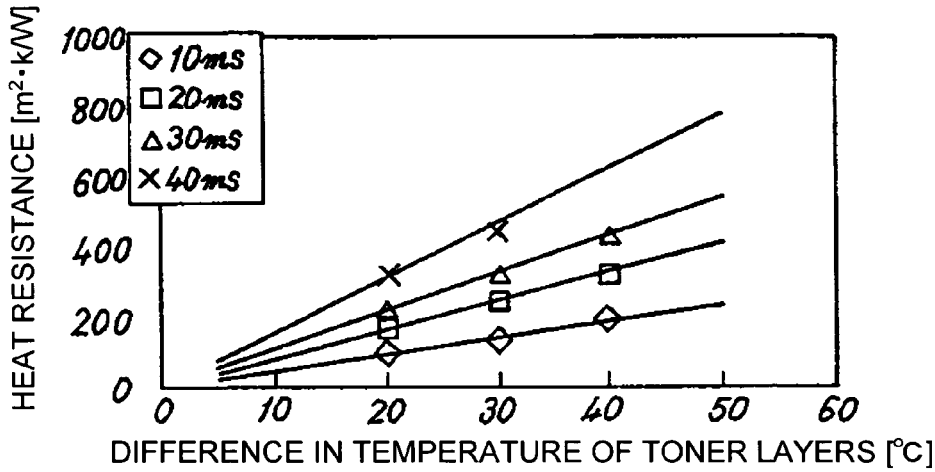
FIG. 7 is a graph of difference in temperatures of toner layer versus heat resistance.

FIG. 7 is a graph of the difference in temperature [° C.] within the toner layers versus the heat resistance [$m^2K/W$] based on the results shown in table 3. From this graph, it can be seen that that the difference in temperature [° C.] within the toner layers and the heat resistance [$m^2K/W$] are proportional to each other.

Figure 8:
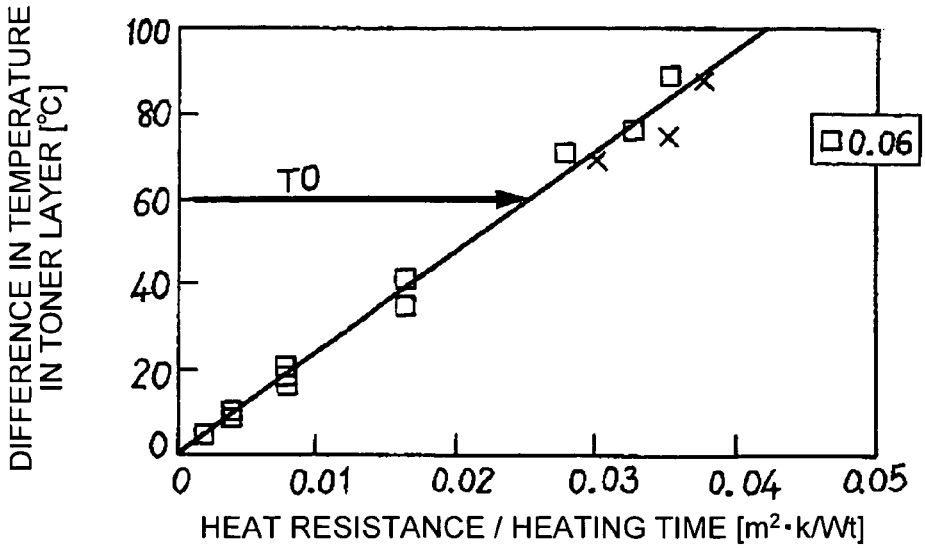
FIG. 8 is a graph of a value of heat resistance divided by the fixing time versus a difference in temperature of toner layer.

Based on these results, a graph of a value that is obtained by dividing the heat resistance [$m^2K/W$] by the fixing time [s] versus the difference in temperature [K] within the toner layers is shown in FIG. 8. From this graph, it can be seen that the value obtained by dividing the heat resistance [m2K/W] and the difference in temperature [° C.] within the toner layers are proportional to each other. Slope S of the graph in this case was $2.4\times10^3$. It was clear from the graph in FIG. 8 that if the values of fixing time [s], the thermal conductivity of the toner [W/mK], and the thickness of the toner layer are known, the difference in temperature within the toner layer can be calculated.

Thus, to prevent the occurrence of the hot offset, the toner top layer temperature $T_{top}$ is to be set lower than the minimum temperature $T_{OFF}$ at which the offset occurs when the fixing time is 1 s. In a case of the toner in the third experiment, the toner top layer temperature $T_{top}$ is to be set to be less than 170° C. Moreover, to satisfy the fixity, the toner bottom layer temperature $T_{bot}$ is set not to be less than the lower limit temperature $T_{MIN}$ for fixing when the fixing time is 1 s. In the case of the toner in the third experiment, the lower limit temperature $T_{MIN}$ for fixing is set not to be less than 110° C. Therefore, in the case of the third experiment, the maximum temperature within the toner layer is 170° C. and the minimum temperature is 110° C. The difference in the temperatures is not greater than 60° C. Therefore, from the results obtained from FIG. 8, to satisfy the following inequality 2, three parameters (fixing time t

[s], thermal conductivity of the toner TC [W/mK], and the thickness of the toner layer [m]) are to be set.

$$2.4\times10^3\times d[m]/TC[W/mK]/t[s]<60 \quad (2).$$

Practically, in FIG. 8, when the occurrence of the hot offset was studied, it was revealed that the hot offset occurs when the difference in temperature of the toner layer is not less than 60° C. (locations of occurrence of hot offset are marked by × in the graph).

Normally, to set the fixing conditions, first of all the toner to be used is chosen. Thus, the thermal conductivity C is determined. Further, the thickness of the toner is chosen according to an image quality. Therefore, minimum fixing time that is not greater than $T_0$ can be calculated from the inequality 2. This enables to find easily the minimum fixing time and to set the fixing conditions such that the power consumption per copy is the least. Finally, from the fixing time, the temperature of the surface of the heating roller is set upon calculating by the method for calculating heat transfer.

When the toner is changed, since the minimum temperature $T_{OFF}$ at which the hot offset occurs and the lower limit temperature $T_{MIN}$ for fixing change, the value of $T_0$ changes. Therefore, if the inequality 2 is generalized, we get inequality 3.

$$2.4\times10^3\times d[m]/TC[W/mK]/t[s]<T_0 \quad (3).$$

Figure 14:
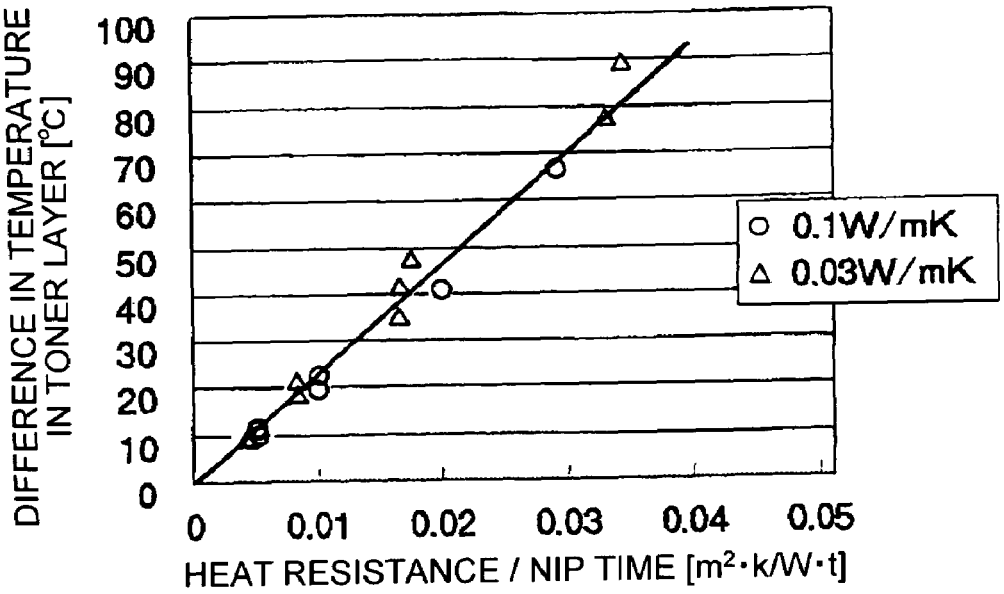
FIG. 14 is a graph of the value of heat resistance divided by the fixing time versus the difference in temperature of toner layers.

Even after changing the toner, it was confirmed that it conformed to the inequality 3 (the slopes of the graph in FIG. 8 were the same). An example of this is shown in FIG. 14.

Exemplary embodiments of an electrophotographic color copying machine (hereinafter, "color copying machine") which is an image forming apparatus according to the present invention are described below.

Figure 11:
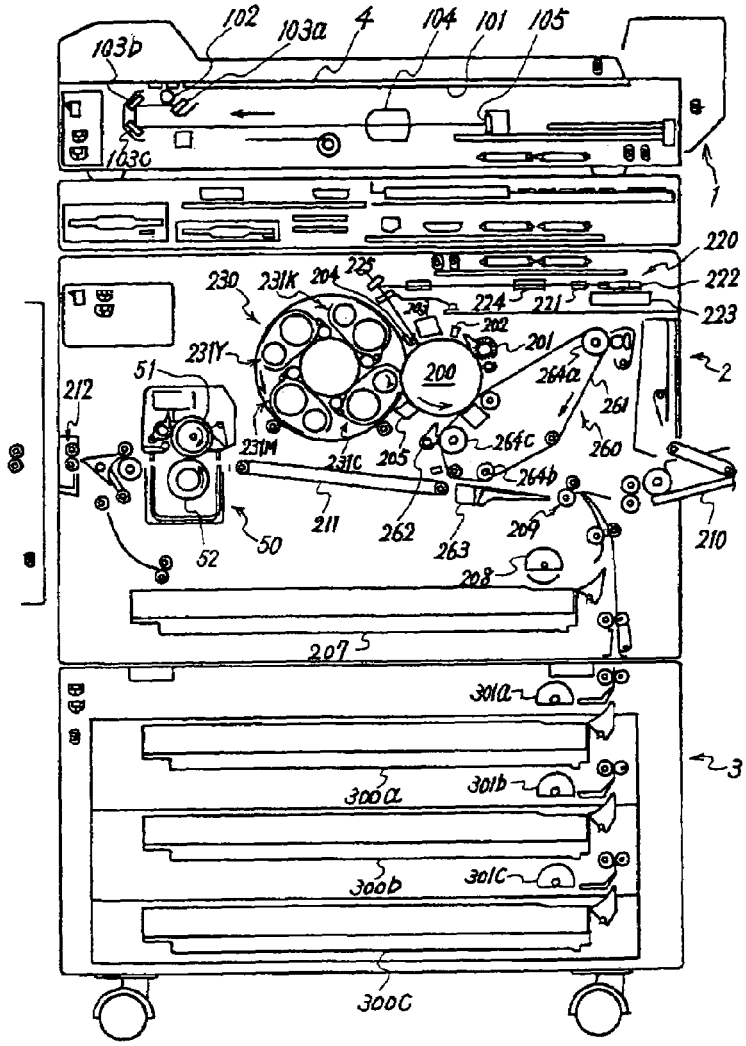
FIG. 11 is a schematic diagram of a color copier according to the first embodiment.

To start with, a general structure and an operation of the color copying machine according to a first embodiment are described with reference to FIG. 11. The color copying machine includes a color image reader (hereinafter, "color scanner") 1, a color image recorder (hereinafter, "color printer") 2, and a paper feeding bank 3.

The color scanner 1 forms on a color sensor 105, an image of a paper document 4 that is placed on an exposure glass 101, via an illuminating lamp 102, a set of mirrors 103*a*, 103*b*, 103*c*, and a lens 104. The color scanner 1 then reads color image information of the paper document 4 for each color-separated light Red, Green, and Blue (hereinafter, "R, G, and B" respectively) and converts it to an electric image signal. The color sensor 105 includes a color separating unit for R, G, and B and a photoelectric transducer such as a CCD. The color sensor 105 reads simultaneously color images of three colors in which the image on the paper document 4 is color-separated. Based on intensity of color separated image signals of R, G, and B achieved by the color scanner 1, conversion is performed in an image processor that is not shown in the diagram and color image data of Black (hereinafter, "Bk"), Cyan (hereinafter, "C"), Magenta (hereinafter, "M"), and Yellow (hereinafter, "Y") is achieved.

The operation of the color scanner 1 to achieve the color image data of Bk, C, M, and Y is as described below. Upon receiving a scanner-start signal with a timing and an operation of the color printer 2 that is described later, an optical system that includes the illuminating lamp 102 and the set of mirrors 103*a*, 103*b*, and 103*c* scans the paper document 4 in a direction of an arrow towards left. Color image data of one color is obtained in each scanning. By repeating this operation four times, a color image data of four colors is achieved one after another. The color image data is visualized one after another in the color printer 2. A final full color image is formed by superimposing these visualized images.

The color printer 2 includes a photosensitive drum 200 as an image carrier, an optical writing unit 220, a revolver developing unit 230, an intermediate transferring unit 260, and a fixing unit 50.

The photosensitive drum 200 rotates in a counterclockwise direction shown by an arrow. A photosensitive drum cleaning unit 201, a decharging lamp 202, a charger 203, a potential sensor 204, a developing machine selected by the revolver developing unit 230, a developing-density pattern detector 205, and an intermediate transfer belt 261 in the intermediate transferring unit 260 are disposed around the photosensitive drum 200.

The optical writing unit 220 converts the color image data from the color scanner 1 to an optical signal, then performs optical writing corresponding to the image of the paper document 4, and forms an electrostatic image on the photosensitive drum 200. The optical writing unit 220 includes a laser diode 221 as a light source, a laser-emission drive controller that is not shown in the diagram, a polygon mirror 222, a motor 223 for rotating the polygon mirror, an f/θ lens 224, and a reflecting mirror 225.

The revolver developing unit 230 includes a Bk developer unit 231K, a C developer unit 231C, an M developer unit 231M, a Y developer unit 231Y, and a revolver rotation drive that rotates each of the developer units in a counterclockwise direction shown by an arrow. Each of the developer units includes a developing sleeve and a developer paddle. The developing sleeve brings a developer in contact with a surface of the photosensitive drum 200 to develop an electrostatic latent image. The developer paddle rotates to scoop up and stir the developer. Toner in each of the developer units 231 is charged to negative polarity by stirring with a ferrite carrier. In a standby condition of the copying machine, the Bk developer unit 231K in the revolver developing unit 230 is set in a position of developing. When copying starts, the color scanner 1 starts reading Bk color image data at a predetermined timing, and based on the color image data, writing by a laser beam and formation of the electrostatic latent image starts (hereinafter, the electrostatic latent image based on the Bk image data is called as a Bk latent image. Similarly, the electrostatic latent images based on C, M, and Y image data are called C latent image, M latent image, and Y latent image). Before a front tip of an electrostatic latent image reaches a Bk developing position at which the developing is possible, from a front tip of a Bk electrostatic latent image, the Bk developing sleeve starts rotating, and develops the Bk electrostatic latent image by a Bk toner. After this, the developing of a Bk electrostatic latent image area continues. At a point of time where a rear tip of an electrostatic latent image passes the Bk developing position, the revolver developing unit 230 rotates till the developer unit for the next color reaches the developing position rapidly. This is to be ended at least before a front tip of an electrostatic latent image from the next image data has reached.

The intermediate transferring unit 260 includes the intermediate transfer belt 261, a belt cleaning unit 262, and a paper transfer corona discharger (hereinafter, "paper transferring unit") 263. The intermediate transfer belt 261 is stretched over a drive roller 264*a*, a roller 264*b* opposite to a transferring side, a roller 264*c* opposite to a cleaning side, and a set of driven rollers. The intermediate transfer belt 261 is driven and controlled by a drive motor that is not shown in the diagram. After the Bk image for the first color is transferred to the intermediate transfer belt 261, while the images of the second, third, and the fourth color are transferred to the intermediate transfer belt 261, the belt cleaning unit 262 keeps away an inlet seal and a blade from the surface of the intermediate transfer belt 261 by a contacting and separating mechanism. The belt transferring unit 263 collectively transfers superimposed toner images on the intermediate transfer belt 261 by a corona discharge.

Transfer paper 5 of various sizes are stored in a transfer paper cassette 207 inside the color printer 2 and transfer paper cassettes 300*a*, 300*b*, and 300*c* inside the paper feeding bank 3. Paper feeding rollers 208, 301*a*, 301*b*, and 301*c* feed and carry a transfer paper of a specified size from the respective cassette, towards a pair of registering rollers 209. A bypass tray 210 is provided on a right side surface of the printer 2 for bypass feeding of an OHP sheet and a board paper.

In a copying machine structured in such a manner, when an image forming cycle starts, to start with, the drive motor that is not shown in the diagram rotates the photosensitive drum 200 in the counterclockwise direction shown by the arrow and the intermediate transfer belt 261 in the clockwise direction shown by the arrow. With the rotating of the intermediate transfer belt 261, a Bk toner image, a C toner image, an M toner image, and a Y toner image are formed. Finally, a superimposed toner image is formed upon superimposing these images on the intermediate transfer belt in an order of Bk, C, M, and Y.

The Bk toner image is formed as described below. The charger 203 charges the photosensitive drum 200 uniformly with negative charge to approximately −700 V, by the corona discharge. Then, the laser diode 221 performs a Raster exposure based on the Bk color image signal. When this Raster image is exposed, from a part exposed of the photosensitive drum 200, which was charged uniformly, electric charge proportional to an amount of exposed light vanishes and the Bk electrostatic latent image is formed. When a negatively charged Bk toner on the Bk developing sleeve comes in contact with this Bk electrostatic latent image, the toner does not adhere to a part of the photosensitive drum 200 on which the electric charge is remained. The Bk toner is adsorbed on a part which has no electric charge on it, in other words a part that is exposed, and the Bk toner image similar to the electrostatic latent image is formed. The Bk toner image formed on the photosensitive drum 200 is transferred to the surface of the intermediate transfer belt 261 by the belt transferring unit 263 (hereinafter, a toner image transfer from the photosensitive drum 200 to the intermediate transfer belt 261 is called as a belt transfer).

The photosensitive drum cleaning unit 201 cleans toner that is remained on the photosensitive drum 200 without being transferred as a preparation for using the photosensitive drum 200 again. The toner, which is recovered at this stage, is stored in a toner discharge tank that is not shown in the diagram, via a recovery pipe.

The photosensitive drum 200 side proceeds to the formation of the next image that is C image after the formation of the Bk image. The color scanner 1 starts reading C color image data at a predetermined timing, and a C electrostatic latent image is formed by laser beam writing according to the C image data. After the rear tip of the Bk electrostatic latent image passes and before a front tip of the C electrostatic latent image reaches, the revolver developing unit 230 rotates. When the revolver developing unit 230 rotates, the C developer unit 231C is set in the developing position and the C electrostatic latent image is developed by a C toner. From here onward, the developing of the C electrostatic latent image area continues. At a point of time where a rear tip of the C electrostatic latent image passes, similarly as in a case of the Bk developer unit 231K, the revolver developing unit 230 rotates and shifts the next M developer unit 231M in the developing position. This, as well, is ended before a front tip of a next M electrostatic latent image reaches the developing position.

Regarding image formation of the M and Y images, reading the respective color data, formation of the electrostatic latent image, and developing being the same as for the Bk and C images, the description is omitted.

The toner images of Bk, C, M, and Y that are formed one after another on the photosensitive drum 200 are aligned on the same surface and a four color superimposed toner image is formed on the intermediate transfer belt. In the next transfer, the four color toner image is transferred collectively to a transfer paper by the belt transferring unit 263.

When the image formation starts, the transfer paper is fed from either a transfer paper cassette or a bypass tray and is in a standby state at a fixing nip of the pair of registering rollers 209. When a front tip of the toner image on the intermediate transfer belt 261 comes near the paper transferring unit 263, the pair of registering rollers 209 is driven such that a front tip of the transfer paper coincides with the front tip of the toner image, thereby adjusting the registering of the transfer paper and the toner image. The transfer paper is then superimposed on the toner image on the intermediate transfer belt 261 and passes over the paper transferring unit 263 that has positive electric potential. At this time, the transfer paper is charged to positive electric charge by corona discharge current and almost the whole of the toner image is transferred to the transfer paper. Further, when the transfer paper passes through a portion that is opposite to a separating decharger by an AC+DC corona that is not shown in the diagram, which is disposed at a left side of the paper transferring unit 263, the transfer paper is decharged. The transfer paper, which is decharged, comes off from the intermediate transfer belt 261 and is shifted to a carrier belt 211.

The transfer paper with the four color superimposed toner image transferred collectively to it from the surface of the intermediate transfer belt 261 is carried to the fixing unit 50. The recording paper with the image fixed on it is carried outside the apparatus by a pair of discharge rollers 212 and stacked in a copy tray that is not shown, with its image side facing upward. Thus, a full color copy is achieved.

The following is a description of the fixing unit 50. FIG. 1 is a schematic diagram of a fixing unit 50 according to the first embodiment of the present invention. In the first embodiment, a roller fixing method is adopted. The fixing unit 50 includes the heating (fixing) roller 51 that has a heat source inside and the pressurizing roller 52. Moreover, the fixing unit 50 includes a cleaning roller, a separating claw that is not shown in the diagram, a transporting roller, and a thermistor 55. The cleaning roller cleans a surface of the heating roller 51. The separating claw separates the heating roller 51 and the pressurizing roller 52. The transporting roller carries a recording paper P upon fixing. The thermistor 55 is a temperature detector, which detects temperature of the heating roller 51 and outputs voltage to perform control so that the temperature of the heating roller 51 equals the target temperature.

The heating roller 51 and the pressurizing roller 52 are in a pressed contact with each other and form the fixing nip A. A recording medium is held and carried to the fixing nip A and a toner image is fixed by melting by heat of the heating roller 51 that is controlled at a predetermined temperature.

To apply a predetermined pressure in the fixing nip A, bias is applied on the heating roller 51 and the pressurizing roller 52 by an elastic body such as a spring that is not shown in the diagram.

The heating roller 51 has a three layered structure. In the first embodiment, a 0.5 mm thick iron pipe is used as a core. A 1.0 mm thick elastic layer of silicon rubber is provided on the core. A 30 $\mu$m thick mold releasing layer of PFA (tetrafluoroethylene and perfluoroalkyl vinyl ethyl copolymer) is provided on a surface of the elastic layer to have better mold releasing characteristics with toner. An outer diameter of the fixing roller is ψ 40.

Taking into consideration an image quality, it is desirable to make a thickness of the elastic layer not less than 50 $\mu$m. However, if the layer is too thick, heat capacity becomes high and warming up time becomes long. Therefore, it is necessary to choose a suitable layer thickness. From a durability point of view, it is desirable to make the thickness of the mold releasing layer not less than 20 $\mu$m. However, if the layer is too thick, surface hardness becomes high, and a surface of contact with the toner becomes non uniform. This gives rise to unevenness in gloss and therefore it is not desirable. Particularly, in a case of color image formation, the thickness of the toner image being different at every point, deterioration of the image is severe. Therefore, it is desirable to set the thickness of the mold releasing layer to not greater than 100 $\mu$m. Moreover, the surface hardness affects not only the thickness of the mold releasing layer but also a thickness of the elastic layer. Therefore, it is necessary to set the thickness of both the mold realizing layer as well as the elastic layer suitably.

The core of the iron pipe may be substituted by an aluminum pipe. The elastic layer of silicon rubber may be substituted by other elastic material. In this case, it is necessary to use material that is heat resistant. For the mold releasing layer, other fluorine contained resin compound may be used as a substitute for the PFA.

A layer structure and a layer thickness of the pressurizing roller 52 are let to be the same as that of the heating roller 51 according to the first embodiment. However, according to the first embodiment, the pressurizing roller 52 does not include a heat source.

The following is a description of a method for setting the fixing conditions.

(1) To start with, a toner to be used is selected. Thus, the thermal conductivity TC of the toner is determined.

(2) The lower limit temperature $T_{MIN}$ for fixing and the minimum temperature $T_{OFF}$ of the surface of the heating roller 51 at which the hot offset occurs when the fixing time is set to 1 s are calculated. Then the difference in temperature $T_0$ between the $T_{MIN}$ and the $T_{OFF}$ is calculated.

(3) A maximum toner layer thickness d is selected according to the image quality.

(4) From the inequality 3, the minimum fixing time t or the fixing time t that can be set is calculated.

(5) When the fixing time t is set to a value calculated in (4), the temperature of the surface of the heating roller 51 that can be set is calculated by calculating the thermal conduction. The temperature of the surface of the heating roller 51 has to be such that the toner top layer temperature $T_{top}$ is not greater than the minimum temperature $T_{OFF}$ of the surface of the heating roller 51 at which the hot offset occurs and the toner bottom layer temperature $T_{bot}$ is not less than the lower limit temperature $T_{MIN}$ for fixing.

(6) The temperature to be set of the heating roller 51 is selected to be a value that is calculated in (5).

Thus, setting the fixing conditions in such a manner enables to prevent the hot offset and to shorten the fixing time, thereby achieving the energy conservation. This enables the high-speed recording as well. In a case of short-time heating, there is no difference in the power consumption irrespective of the type or thickness of the recording medium, which is another advantage. This is because of the following reasons. In other words, if the fixing time is long, an excessive amount of heat is imparted to the recording paper and the power consumption per copy increases. On the other hand, if the fixing time is short, the amount of heat imparted to the recording paper can be suppressed to minimum.

Thus, with the shortening of the fixing time, the power consumption for fixing per copy is reduced (refer to FIG. 3). Particularly, if the fixing time is not greater than 0.02 s, the reduction in the power consumption for fixing per copy is the maximum (refer to FIG. 3). Therefore, it is desirable to set the fixing time to a value not greater than 0.02 sec. When the fixing time is set to 0.02 s, a width of the fixing nip A is let to be 5.0 mm and a transporting speed of the recording paper is let to be 250 mm/s. It is desirable to have the short fixing time, as shorter the fixing time it is useful for the energy conservation. However, if the fixing time is shortened, since the temperature of the heating roller 51 is to be set high (refer to FIG. 2), the minimum value of the fixing time is determined by a heat resistance of the heating roller 51 and a temperature of the toner at which the fixing is possible. For example, if the silicon rubber that has heat resistance temperature 240° C. is used as the elastic layer of the heating roller 51 and the toner layer thickness is let to be 20 $\mu$m, with the toner used in the first experiment, 0.01 s is the minimum value as the fixing time (refer to FIG. 2). Normally, from the point of view of such a minimum value, it is desirable that the minimum value is not less than 0.005 s.

Figure 9:
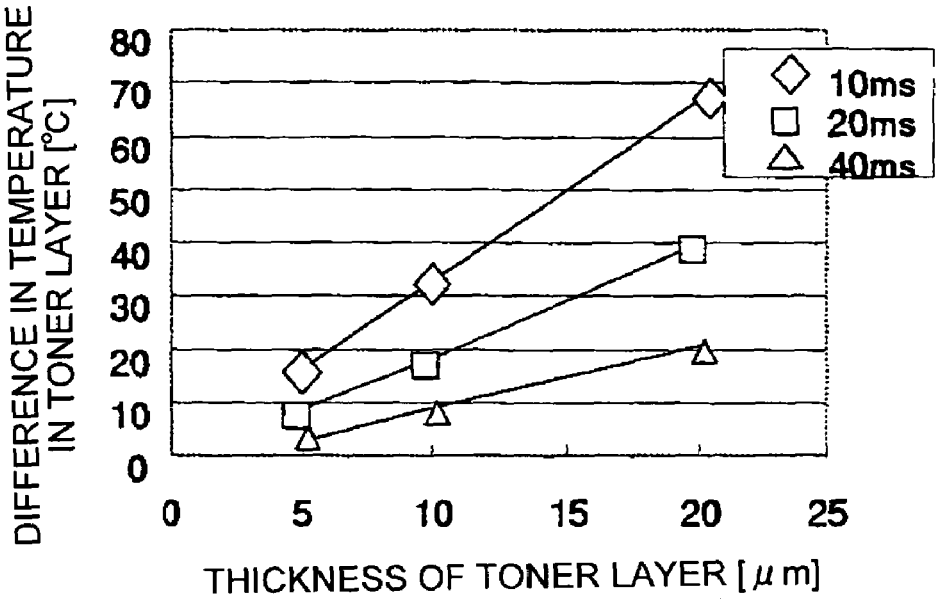
FIG. 9 is a graph of thickness of toner layer versus the difference in temperature of toner layer.

FIG. 9 is a graph of thickness of the toner layer versus the difference in the temperature in the toner layer. When the fixing time is let to be 0.01 s, to let the difference in the temperature of the toner not to be greater than 60° C., it is necessary to let the thickness of the toner layer not to be greater than 16 $\mu$m. When the fixing time is let to be 0.02, to let the difference in the temperature of the toner not to be greater than 60° C., it is necessary to let the thickness of the toner layer not to be greater than 29 $\mu$m. With the increase in the fixing time, there is a rise is a tolerance of the thickness of the toner layer.

As the toner layer becomes thin, there is a decline in the power consumption for fixing per recording paper (refer to FIG. 3). Therefore, it is desirable that the film thickness of the toner layer is thin. For example, when the fixing time is to be set to 0.01 s, for a 20 $\mu$m thick toner layer, it is necessary to set the temperature of the surface of the heating roller 51 to a value not less than 240° C. When the fixing time is to be set to 0.01 s, for a 10 $\mu$m thick toner layer, it is necessary to set the temperature of the surface of the heating roller 51 to a value not less than 220° C. When the fixing time to be set to 0.01 s, for a 5 $\mu$m thick toner layer, it is necessary to set the temperature of the surface of the heating roller 51 to a value not less than 210° C. Therefore, for shortening the fixing time, it is better to reduce the thickness of the toner layer. In a multi color image, taking into consideration the thickening of the toner layer, it is desirable to do setting such that an average of the thickness of the toner layer at the maximum concentration is not greater than 15 μm. From the results obtained from FIG. 3, from the point of view of energy conservation, it is desirable to have the toner layer as thin as possible. However, it is necessary to set it in a range that does not affect the image quality. With a toner in the current state, in a case of the multicolor image, it is appropriate to set the thickness to a value not less than 10 μm and in a case of a single color image, it is appropriate to set the thickness to a value not less than 5 μm.

Figure 10:
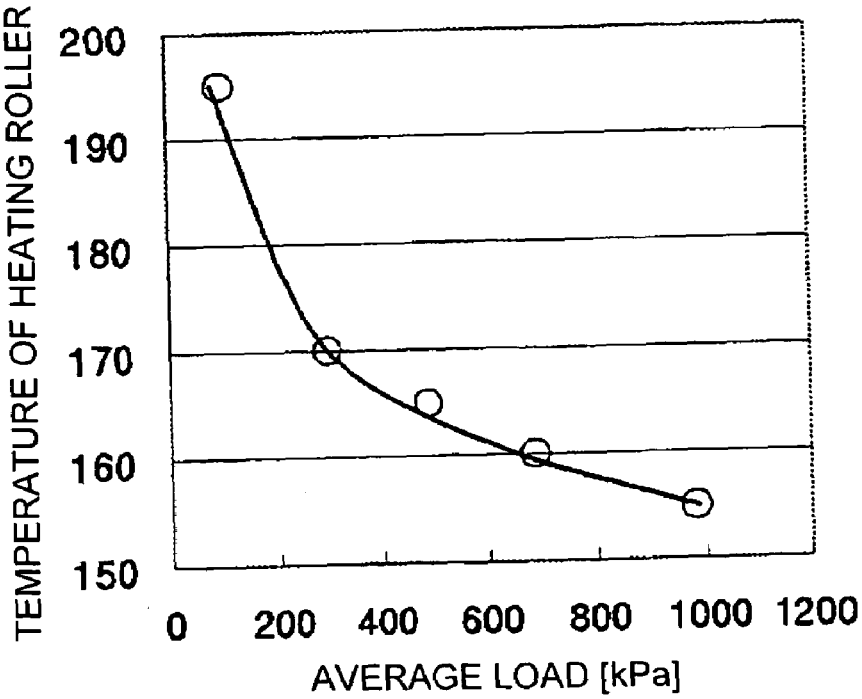
FIG. 10 is a graph of an average load per unit area of a fixing nip versus a lower limit temperature for fixing.

FIG. 10 is a graph of a change in an average load per unit area of the fixing nip A versus the lower limit temperature $T_{MIN}$ for fixing. In this case, the fixing time is let to be 0.02 s.

From this graph, it can be seen that even for the same fixing time, the lower limit temperature $T_{MIN}$ for fixing changes according to the average load per unit area of the fixing nip A. If the average load per unit area of the fixing nip A is set high, the temperature of the heating can be lowered. With the shortening of the fixing time, there is a rise in the lower limit temperature $T_{MIN}$ for fixing. However, it can be seen that by raising the average load per unit area of the fixing nip A, the lower limit temperature $T_{MIN}$ for fixing can be lowered. If the load is more, the toner layer becomes thin rapidly. This is considered to be due to a reduction in the difference in temperature in the toner layer. If the fixing temperature can be lowered, the power consumption can be reduced. Moreover, it is effective for preventing a problem of heat resistance of components that form the fixing member and thermal destruction due to a rise in temperature during a continuous passing of paper.

From the graph in FIG. 10, it can be seen that the reduction in the lower limit temperature $T_{MIN}$ for fixing is more for the average load per unit area of the fixing nip A not less than 290 kPa. Therefore, it is desirable to set the average load per unit area of the fixing nip A to a value not less than 290 kPa. According to the first embodiment, taking into consideration durability according to deformation due to bending at a time of start up, the average load per unit area of the fixing nip A is set to 290 kPa to have stable pressurizing by reducing the heat capacity. However, it is desirable that the average load per unit area of the fixing nip A is high. It is necessary to determine an upper limit by taking into consideration the strength of structural elements. Moreover, when the average load per unit area of the fixing nip A is set high, the following problem arises. There may be a deformation of fibers of the recording paper, a change in the gloss of the recording paper, and a noise while the recording paper passes through the fixing nip A. Moreover, it is necessary to make a large scale structure. Therefore, it is desirable that the average load per unit area of the fixing nip A is set to a value not greater than 2000 kPa.

According to the first embodiment, toner with an average particle size 5 μm of each color is used. Since a smear process is performed for the Bk image, a toner other than Bk toner is not superimposed. Therefore, since the maximum toner thickness is formed by the toners of three colors, it is 15 μm.

The toner thickness and the average particle size of the toner were varied and a uniformity of concentration was evaluated. The thickness of the toner layer was adjusted by reducing the amount of toner adhered during the developing and transferring. The evaluation was made in five stages by visual observation. A fifth rank indicates a good image without unevenness in density; a fourth rank indicates an image that is visually acceptable, and ranks from a first rank to a third rank indicate defective unevenness in concentration. The results are shown in table 4.

TABLE 4

| | Evaluation of unevenness in concentration of image | | | |
|---|---|---|---|---|
| Average particle size | Thickness of toner layer 10 μm | Thickness of toner layer 15 μm | Thickness of toner layer 20 μm | Thickness of toner layer 30 μm |
| 5 μm | 4 | 5 | 5 | 5 |
| 8 μm | 3 | 4 | 4 | 5 |
| 10 μm | 2 | 3 | 4 | 5 |

From table 4, to satisfy the unevenness in the density of the image, it can be understood that it is necessary to make the average particle size smaller as the toner layer becomes thinner. The reason being that, if the particle size of the toner is big, a dotted patch is remarkable, thereby resulting in a loss of evenness of the image. Therefore, it is desirable to take the particle size of the toner not greater than 5 μm. However, taking into consideration problems in manufacturing, it is desirable to set the lower limit of the toner particle size to a value not less than 1 μm.

On the other hand, when the thickness of the toner layer is reduced by letting the average particle size of the toner to be not greater than 5 μm, there is a decline in color reproducibility. This is because, as the toner layer after the fixing becomes thinner as compared to the toner layer before fixing, light can be transmitted easily with the conventional degree of coloring and the desired reflection density cannot be achieved. Therefore, according to the first embodiment, it is desirable to increase a coloring density. As a pigment density, normally percentage by weight of the toner is normally 5% and it is desirable to let it to be 15%.

Apart form the method mentioned above (the method of reducing the amount of toner to be adhered during the developing and transferring) for adjusting the thickness of the toner layer, a method of thinning the toner of each color in the image processing is available. According to this method, when the thickness of the toner layer was let to be 10 μm and the average particle size of the toner was let to be 8 μm or 10 μm, the rank was lower similarly as in the previous case.

In the first embodiment, a polymerized toner is used. The polymerized toner has a high degree of circular shape and a low manufacturing cost. The degree of circular shape according to the first embodiment is not less than 0.96 and less than 1.00. If the degree of circular shape is high, percentage of void in the toner layer becomes low. Therefore, an insulation effect of air becomes less and the thermal conductivity becomes high. If the thermal conductivity is high, the difference in temperature within the toner layer is low and it is useful for preventing the offset.

Moreover, in a case of the polymerized toner, the control of particle distribution being easy, a toner of the desired average particle size can be supplied stably. Therefore the thickness of the toner layer is stabilized. Furthermore, a toner having a small particle size that can enter into gaps between the toner particles is mixed. For example, with a toner that has a bipolarized particle distribution, if a toner of a particle size that is ⅕ of a toner having a big particle size is used, a filling rate of the toner layer becomes higher and the thermal conductivity of the toner layer increases. Therefore, it is useful for preventing the offset. Thus, it is desirable that the particle size distribution is at least bipolarized or above. However, if the particle size distribution is more than the tetra polarized particle size distribution, the effect of filling the gaps is reduced. Therefore, it is desirable that the particle size distribution is not above the tetra polarized particle size distribution.

In the first embodiment, the setting is done in order that the fixing conditions become such that the control temperature of the heating roller 51 becomes not greater than 230° C. This enables to prevent deterioration caused due to heat of the components such as the heating roller 51.

Moreover, according to the first embodiment, crystalline polyester is included in a toner composition. The inclusion of the crystalline polyester enables sham melting (low melting point) and softening temperature can be reduced. Therefore, since the toner can be softened by using a small amount of energy, the toner layer is squashed rapidly and becomes thin. Therefore, the difference in the temperature in the toner layer becomes small. Further, since the softening is rapid, a desired interface temperature between the paper and the toner is attained easily, thereby enabling to reduce the control temperature of the fixing component. Therefore, a tolerance of temperature range from the occurrence of the offset till the rise in temperature is widened. Moreover, components of the fixing unit are prevented from the thermal destruction. Furthermore, the start-up time is shortened and power consumption is reduced.

Using a fixing component that has a low hardness, which can be in a very close contact with irregularities of the paper and the toner, reduces the difference in temperature in the toner layer and is useful for preventing the offset. This is because if the fixing component is hard, a toner with recesses on it does not come in a direct contact with the fixing component and it is melted by the conduction of heat via an air space. In such a case, the lower limit temperature $T_{MIN}$ for fixing rises up and a temperature range up to the minimum temperature $T_{OFF}$ at which the offset occurs becomes narrow. However, by using the fixing component of low hardness, the heat is conducted easily and the temperature of the fixing component that melts the toner can be reduced. As a result, a tolerance of the temperature range up to the minimum temperature $T_{OFF}$ at which the offset occurs becomes wide. The low hardness in this case is a micro hardness of the surface. The micro hardness is expressed in terms of universal hardness HU for forced depth 10 $\mu$m and it is desirable that the micro hardness is not greater than 2.5 $N/mm^2$. The universal hardness HU is equal to load/cross sectional area of a portion in which a measuring probe is pierced and is a standard based on DIN 50359, ISO 14577. A load-displacement behavior during forced load in an ultra micro region is recorded continuously. A recording in such a manner is characterized by enabling more detailed recording of physical properties of a belt surface-film as compared to that by a conventional method of measuring the hardness. Vickers indentator is used for the measuring terminal.

The following is a description of the toner used in the first embodiment.

Method of Manufacturing Polymerized Toner

For manufacturing the toner that has the degree of circular shape from 0.96 to 1.00, various methods of manufacturing particles by a wet process such as a suspension polymerization method, an emulsification and coagulation method, a dispersion polymerization method, an interfacial polymerization method, dissolution and suspension method, and a phase inversion emulsification method are available. Even in a case of toner that is manufactured by pulverizing and classifying molten and kneaded material, a toner with a high degree of circular shape can be manufactured by heat treatment of the toner. However, this is not favorable from the point of view of energy efficiency.

The suspension polymerization method and the dispersion polymerization method are standout methods as they enable to achieve stably a toner that has a high degree of circular shape, a sharp distribution of particle size, and an appropriate control of charging of the toner. The dissolution and suspension method is a standout method as it enables to use a polyester resin, which is useful from a point of view of low temperature fixity of the toner. The suspension polymerization method, the dispersion polymerization method, and the dissolution and suspension method are described below in detail.

Suspension Polymerization Method

A dispersion stabilizer and a colorant, and if required a cross linking agent, a charging control agent, a mold releasing agent are dispersed uniformly in a specific monomer that is mentioned later, by using a ball mill. After dispersing, a polymerization initiator is added to this mixture to obtain a monomer phase. The monomer phase and an aqueous dispersive medium phase that is prepared in advance by stirring are put in a mixing vessel and stirred by a homogenizer. A suspension that is obtained upon stirring is subjected to nitrogen replacement and then heated to end the polymerization reaction in order to obtain colored resin particles. These colored resin particles are washed and dried to obtain toner particles having high degree of circular shape.

The polymerizable monomer used in the suspension polymerization has a vinyl group. The following are concrete examples of the polymerizable monomer. Styrene and its derivatives such as o-methylstyrene, m-methylstyrene, p-methylstyrene, 2.4×103-dimethylstyrene, butylstyrene, octylstyrene and from among these monomers, styrene monomers are the most desirable. Examples of other vinyl monomers are unsaturated mono olefins of ethylene series such as propylene, butylene, isobutylene, vinyl halides such as vinyl chloride, vinylidene chloride, vinyl bromide, vinyl fluoride, vinyl esters such as vinyl acetate, vinyl propionate, vinyl benzoate, vinyl butyrate, α-methylene aliphatic monocarbonates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-ethyl chloride acrylate, phenyl acrylate, α-methyl chloroacrylate, methyl methacrylate, ethyl methacrylate, propyl methacrylate, n-butyl methacrylate, isopropyl methacrylate, n-octyl methacrylate, dodecyl methacrylate, 2-ethylhexyl methacrylate, stearyl methacrylate, phenyl methacrylate, and diethyl aminoethyl methacrylate, acrylates such as acrylonitrile, methacrylonitrile, and acryloamide or their derivatives, vinyl ethers such as vinyl methyl ether and vinyl isobutyl ether, vinyl ketones such as vinyl methyl ketone, vinyl hexyl ketone, and methyl isopropyl ketone, N-vinyl compounds such as N-vinylpyrrole, N-vinylcarbazole, N-vinylindole, and N-vinylpyrrolidone, and further vinylnaphthalene. These monomers can be used independently or upon mixing.

In the suspension polymerization method, to produce a cross-linked polymer, the polymerization may be carried out upon allowing the following cross linking agent to exist in a composition of the monomer. Examples of the cross-linking agent are divinylbenzene, divinyinaphthalene, polyethylene glycol diacrylate, diethylene glycol diacrylate, triethylene glycol diacrylate, 1,3-butylene glycol diacrylate, 1,6-hexane glycol dimethacrylate, neopentyl glycol diacrylate, dipropylene glycol methacrylate, polypropylene glycol dimethacrylate, 2,2'-bis(4-methacryloxy diethoxy phenyl) propane, 2,2'-bis(4-acryloxy diethoxy phenyl)propane, trimethylol propane trimethacrylate, trimethylol methane tetraacrylate, dibromo neopentyl glycol dimethacrylate, and diallyl pthalate. If an amount of cross linking agent used is too much, the toner is not melted easily by heat, thereby resulting in deterioration of heat fixity and thermal pressure fixity. If an amount of the cross linking agent used is too less, there is a decline in properties such as a blocking resistance and durability which are necessary for a toner. Due to this decline in the properties, in a heat roller fixing method, a part of the toner is not stuck perfectly to the paper and is adhered to a surface of the roller. This toner adhered to the surface of the roller is transferred to the next paper. This phenomenon is called as offset. Therefore, the amount of the cross linking agent is 0.001 parts by weight to 15 parts by weight for 100 parts by weight of the polymerizable monomer and a desirable amount of the cross linking agent is 0.1 parts by weight to 10 parts by weight.

Examples of dispersion stabilizer that can be used in the suspension polymerization method are water-soluble high polymers such as polyvinyl alcohol, starch, methyl cellulose, carboxymethyl cellulose, hydroxymethyl cellulose, sodium polyacrylate, and sodium polymethacrylate. Barium sulfate, calcium sulfate, barium carbonate, magnesium carbonate, calcium phosphate, talc, clay, diatomaceous earth, and powders of metal oxide compounds can also be used as a dispersion stabilizer. It is desirable to use the dispersion stabilizer in a range of 0.1 percent by weight to 10 percent by weight with respect to water.

In the suspension polymerization method, the polymerization initiator may be added to a dispersion that includes the monomer composition after preparing the particles. However, from a point of view of imparting the polymerization initiator uniformly to each of the particles of the monomer composition, it is desirable to add the polymerization initiator to the monomer composition before preparing the particles. Examples of such a polymerization initiator are azo or diazo polymerization initiators such as 2,2'-azo-bis-(2.4×102-dimethyl valeronitrile), 2,2'-azo-bis-isobutylonitrile, 1,1'-azobis-(cyclohexane-1-carbonitrile), 2,2'-azo-bis-4-methoxy-2.4×103-dimethyl valeronitrile, and azo-bis-butylonitrile, and peroxide polymerization initiators such as benzoyl peroxide, methylethyl ketone peroxide, isopropyl peroxide, 2.4×103-dichloro benzoyl peroxide, and lauryl peroxide.

A magnetic toner that includes magnetic material can be manufactured by the suspension polymerization method. Magnetic particles are to be added to the monomer composition to manufacture the magnetic toner. A powder of a ferromagnetic metal such as iron, cobalt, and nickel or a powder of an alloys or a compound such as magnetite, hematite, and ferrite can be used as the magnetic material. Magnetic particles of particle size from 0.05 $\mu$m to 5 $\mu$m are used and magnetic particles of particle size from 0.1 $\mu$m to 1 $\mu$m are desirable. For preparing a toner having a small particle size, it is desirable to use magnetic particles of particle size not greater than 0.8 $\mu$m. It is desirable that 10 parts by weight to 60 parts by weight of the magnetic particles are included in 100 parts by weight of the monomer composition. Moreover, the magnetic particles may have been treated by a surface treatment agent such as a silane coupling agent and a titanate coupling agent or by a resin that has a suitable reactivity. In this case, an amount of the surface treatment agent depends on a surface area of the magnetic particles or a density of a hydroxyl group on the surface. However, with 5 parts by weight of the surface treatment agent with respect to 100 parts by weight of the magnetic material, and desirably from 0.1 to 3 parts by weight of the magnetic material, dispersion to sufficient amount of polymerizable monomer can be achieved and there is no adverse effect on properties of toner.

Dispersion Polymerization Method

A high polymer dispersing agent that dissolves in a hydrophilic organic liquid is added to a hydrophilic organic liquid. The high polymer dispersing agent dissolves in the hydrophilic compound. However, the polymer is prepared either by swelling in the hydrophilic organic liquid or by adding vinyl polymers of one or more than one type that are almost insoluble. A reaction that causes growth by such a system by using polymer particles of a size smaller than the originally targeted size and with a narrow particle size distribution is also included. Monomer to be used for the growth reaction may be the same monomer of which seed particles were manufactured, or a different monomer. The polymer has to dissolve in the hydrophilic organic liquid.

Alcohols such as methyl alcohol, ethyl alcohol, denatured ethyl alcohol, isopropyl alcohol, n-butyl alcohol, isobutyl alcohol, t-butyl alcohol, s-butyl alcohol, t-amyl alcohol, 3-pentanol, octyl alcohol, benzyl alcohol, cyclohexanol, furfuryl alcohol, tetrahydrofurfuryl alcohol, ethylene glycol, glycerin, diethylene glycol, and ether alcohols such as methylcellosolve, cellosolve, isopropylcellosolve, butylcellosolve, ethylene glycol monomethyl ether, ethylene glycol monoethyl ether, diethylene glycol monomethyl ether, diethylene glycol monoethyl ether are typical examples of hydrophilic organic liquids as diluents of the monomer that is used during forming and the growth reaction of the seed particles.

These organic liquids can be used independently or by mixing more than one type of organic liquid. Organic liquids other than alcohols and ether alcohols can be used together with the alcohols and the ether alcohols mentioned above. By doing so, under a condition that the polymer particles that are formed are not dissolved in the organic liquid, the polymerization is carried out by changing an SP value to various values. This enables to control the size of the particles formed, combining of seed particles, and the forming of new particles. Hydrocarbons such as hexane, octane, petroleum ether, cyclohexane, benzene, toluene, and xylene, halogenated hydrocarbons such as carbon tetrachloride, trichloroethylene, and tetrabromoethane, ethers such as ethyl ether, dimethyl glycol, siloxane, and tetrahydrofuran, acetals such as methylal and diethyl acetal, ketones such as acetone, methyl ethyl ketone, methyl isobutyl ketone, and cyclohexane, esters such as butyl formate, butyl acetate, ethyl propionate, and cellosolve acetate, acids such as formic acid, acetic acid, and propionic acid, and sulfur or nitrogen containing organic compounds such as nitropropane, nitrobenzene, dimethylamine, monoethanolamine, pyridine, dimethylsulfoxide, and dimethylformamide, and water are examples of the organic compounds to be used together.

The average particle size, the particle size distribution, and drying conditions of the polymer particles that are formed, can be adjusted by changing the type and composition of solvents to be mixed at a start of the polymerization, during the polymerization, and at an end of the polymerization.

Suitable examples of high polymer dispersing agents that are used in the manufacturing of seed particles or growing particles are homopolymers or copolymers that include acids such as acrylic acid, methacrylic acid, $\alpha$-cyanoacrylic acid, $\alpha$-cyanomethacrylic acid, itaconic acid, crotonic acid, fumaric acid, maleic acid, and maleic acid anhydride, acrylic monomers that include a hydroxyl group, which includes vinyl alcohol such as β-hydroxy ethylacrylate, β-hydroxy methylacrylate, β-hydroxy propylacrylate, β-hydroxy propylmethacrylate, γ-hydroxy propylacrylate, γ-hydroxy propylmethacrylate, 3-chloro-2-hydroxy propylacrylate, 3-chloro-2-hydroxy propylmethacrylate, diethylene glycol monoacrylic ester, diethylene glycol monomethacrylic ester, glycerin monoacrylic ester, glycerin monomethacrylic ester, N-methylolacrylamide, N-methylolmethacrylamide, or ethers such as vinylmethylether, vinylethylether, and vinylpropylether with these vinyl alcohols, or esters of compounds that include vinyl alcohol and carboxyl group such as vinyl acetate, vinyl propionate, and vinyl butyrate, or acrylamide, methacrylamide, diacetone acrylamide or their methylol compounds, chloride acrylates such as chloride acrylate and chloride methacrylate, and compounds such as vinylpyridine, vinylpirolidone, vinylimidazole, and ethyleneimine or homopolymers or copolymers of compounds that include a heterocycle of nitrogen atom. Polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester, and celluloses such as methyl cellulose, hydroxyethyl cellulose, and hydroxypropyl cellulose, copolymers of hydrophilic monomers with compounds such as styrene, α-methylstyrene, and vinyltoluene that have a benzene nucleus or derivatives of these compounds, or copolymers of hydrophilic monomers with acrylic acids such as acrylonitrile, methacrylonitrile, and acrylamide or methacrylic acid derivatives, and copolymers of hydrophilic monomers with cross-linked monomers such as ethylene glycol dimethacrylate, diethylene glycol dimethacrylate, allyl methacrylate, and divinylbenzene can also be used as high polymer dispersing agents that are used in the manufacturing of seed particles or growing particles.

These high polymer dispersing agents are selected suitably according to the hydrophilic organic liquid, seeds of the polymer particles that are targeted, and according to whether it is a manufacturing of the seed particles or a manufacturing of the growing particles. However, to prevent combining the polymer particles mainly three-dimensionally, a high polymer dispersing agent that has high affinity and adsorptivity towards surface of the polymer particles as well as high affinity and adsorptivity towards the hydrophilic organic liquid is selected. To improve repulsion among the particles three-dimensionally, a high polymer dispersing agent that has a molecular chain, which is somewhat long, desirably a high polymer dispersing agent with a molecular weight not less than 10,000 is selected. However, if the molecular weight is too high, there is a remarkable rise in a viscosity. Hence, precaution is necessary as the rise in the viscosity affects an operation and a stirring, thereby causing unevenness in deposition probability on a surface of the growing particles of the polymer formed. Allowing a part of a monomer that is a high-polymer dispersing agent, to coexist in a monomer that is included in the target polymer particle, is an effective measure for stabilizing.

By using a metal such as cobalt, iron, nickel, aluminum, copper, tin, lead, and magnesium or a metal alloy of such metals (particularly, of particle size not bigger than 1 μm is desirable), inorganic compound fine particles of an oxide such as iron oxide, copper oxide, nickel oxide, zinc oxide, titanium oxide, silicon oxide, an anionic surfactant such as fatty alcohol sulfate, alkyl benzene sulfonate, α-olefin sulfonate, ester phosphate, an amine salt group such as an alkylamine salt, a derivative of aminoalcohol fatty acid, derivative of polyamine fatty acid, and imidazoline, a cationic surfactant of a quaternary ammonium salt type such as an alkyltrimethylammonium salt, a dialkyldimethylammonium salt, an alkyldimethylbenzylammonium salt, pyridium salt, alkylisoquinolinium salt, and benzethonium chloride, a nonionic surfactant of derivatives of a fatty acid amide and derivatives of a polyhydric alcohol, and an ampholytic surfactant of aminoacid type or betaine type such as alanine type, for example dodecyl di-(aminoethyl)glycine and di-(octylaminoethyl)glycine with these high polymer dispersing agents, the stability and the particle distribution of the polymer particles formed can be improved further.

Normally, an amount of the high-polymer dispersing agent that is used in the manufacturing of the seed particles varies according to a type of the polymerizable monomer that is to be used for formation of the polymer particle. However, the amount of the high-polymer is from 0.1 percent by weight to 10 percent by weight of the hydrophilic organic liquid, and the desirable amount is from 1 percent by weight to 5 percent by weight. If a concentration of a high-polymer dispersion stabilizer is low, polymer particles of a comparatively bigger size are formed and if the concentration of the high-polymer dispersion stabilizer is low, polymer particles of a smaller size are formed. However, even if more than 10 percent by weight of the high-polymer dispersing agent is used, it is not much useful for reducing the particle size.

The vinyl monomers are compounds that are dissolvable in hydrophilic organic liquid. Examples of the vinyl monomers are styrenes such as styrene, o-methylstyrene, m-methylstyrene, p-methylstyrene, α-methylstyrene, p-ethylethylene, 2.4×103-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene, α-methyl fatty acid monocarboxylic acid esters such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-choroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, and diethylaminoethyl methacrylate, derivatives of methacrylates or acrylates such as acrylonitrile, methacrylonitrile, and acrylamide, vinyl halides such as vinyl chloride, vinylidene chloride, vinyl bromide, and vinyl fluoride. These can be used independently or a mixture of these can be used. The mixture here means a mixture with a monomer that is obtained by polymerizing with not less than 50 percent by weight of these compounds. To have a high offset-resistance, the polymer may be obtained by polymerizing in presence of the so called cross linking agent that has more than one polymerizable double bond. Examples of cross linking agents that can be used desirably are divinyl benzene, divinyl naphthalene and aromatic divinyl compounds that are derivatives of divinyl benzene and divinyl naphthalene. Other examples are divinyl compounds of N,N-divinyl aniline, divinyl ether, divinyl sulfide, and divinyl sulfone, diethyleny carboxylic acid esters such as ethylene glycol dimethacrylate, diethylene glycol methacrylate, triethylene glycol methacrylate, trimethylolpropane triacrylate, allyl methacrylate, tert-butylaminoethyl methacrylate, tetraethylene glycol dimethacrylate, 1,3-butanediol dimethacrylate, and compounds having more than two vinyl groups. These can be used independently or as a mixture.

When a growth polymerization reaction is carried out by using cross linked seed particles, inside of polymer particles that grow is linked. Moreover, on the other hand, when a vinyl monomer liquid that is used in the growth reaction is included in the cross linking agent, a polymer with a hardened surface of particles is obtained.

To adjust an average molecular weight, the polymerization is carried out in presence of a compound that has a high chain transfer constant. Examples of such a compound are carbon tetra chloride and carbon tetra bromide that has a mercapto group.

An azo-based polymerization initiator such as 2,2'-azo-bis-isobutylonitrile and 2,2'-azo-bis-(2.4×103-dimethyl valeronitrile), a peroxide-based polymerization initiator such as lauryl peroxide, benzoyl peroxide, and t-butyl per-octoate, a persulfate-based polymerization initiator such as potassium persulfate, and a group in which sodium thiosulfate and amine etc. is used together with these are used as the polymerization initiator of the monomer.

Polymerization conditions for achieving the seed particles, which are high-polymer dispersing agent in the hydrophilic organic liquid, the concentration of the vinyl monomer, and compounding proportion are determined according to a target average particle size of the polymer particles and a target particle size distribution. Normally, if the average particle size of the particles is to be made smaller, concentration of the high-polymer dispersing agent is to be set high and if the average particle size of the particles is to be made bigger, the concentration of the high-polymer dispersing agent is to be set low. On the other hand, if the particle size distribution is to be made very sharp, concentration of the vinyl monomer is to be set low and if a comparatively wide distribution is acceptable, the concentration of the vinyl monomer is to be set high.

To manufacture the particles, the high-polymer dispersion stabilizer is dissolved completely in the hydrophilic organic liquid. One or more than one type of vinyl monomer, a polymerization initiator if required, inorganic fine particles, a surfactant, dye, and pigments etc are added upon dissolving the high-polymer dispersion stabilizer. The mixture is stirred normally at 30 rpm to 300 rpm. It is desirable that the mixture is stirred at as low speed as possible with turbine shaped blades rather than paddle shaped blades, and the mixture is stirred in such a manner that a flow in a vessel is uniform. While stirring, the mixture is heated to a temperature that is appropriate to a rate of polymerization of the polymerization initiator that is used. Thus, the polymerization is carried out. Temperature in an initial stage of polymerization has a profound effect on the particle seeds formed. Therefore, it is desirable to raise the temperature up to a polymerization temperature after adding the monomer and to introduce the polymerization initiator after dissolving it in a small amount of a solvent. While carrying out the polymerization, it is necessary to remove oxygen in air inside a reactor vessel by using an inert gas such as nitrogen and argon. If an oxygen purge is not sufficient, there is a tendency to form fine particles. To carry out polymerization in a high-conversion area, a polymerization time from 5 hours to 40 hours is necessary. The polymerization can be speeded up by stopping the polymerization at a desired state of particle size or particle size distribution, by gradually adding the polymerization initiator, or by carrying out the reaction under a high pressure.

The dying may be carried out after completion of the polymerization or after recovering polymer slurry upon removing unnecessary fine particles, monomer remained, and high-polymer dispersion stabilizer etc. by a process such as sedimentation, centrifugal separation, and decantation. However, leaving the dispersion stabilizer without removing improves the stability and suppresses an unnecessary coagulation.

The following is a description of dying in dispersion polymerization. Resin particles are dispersed in an organic solvent in which the resin particles are not dissolved. Before or after dispersing the resin particles, a dye is dissolved in the organic solvent. The particles are colored by allowing the dye to penetrate into the resin particles. The organic solvent is removed after coloring. A colored toner is manufactured by using this method. In this method of manufacturing the colored toner, a dye for which a relation (D1)/(D2)≦0.5 is satisfied, is selected and used. Here, (D1) is a solubility of the dye in the organic solvent and (D2) is a solubility of the dye in a resin of the resin particle A. This enables to manufacture a toner efficiently in which the dye is penetrated (scattered) deep into the resin particles. The solubility mentioned in this specification is defined as solubility measured at a temperature of 25° C. The solubility of the dye in the resin is defined similarly as a solubility of the dye in the solvent and means a maximum amount of a dye that can be included in compatible condition in a resin. Dissolving or deposition of the dye can be observed easily by using a microscope. The solubility of the dye in the solvent may also be found by using an indirect method of observation instead of the direct method of observation by using a microscope. According to this method, a liquid that has approximately the same solubility coefficient as that of a resin, in other words, a solvent in which the resin is dissolved well, is used. The solubility of a dye in this solvent may be taken as solubility in the resin.

The dye to be used for coloring is required to have a ratio (D1)/(D2) of the dye in the resin in the resin particles than the solubility (D1) of the dye in the organic solvent used, not greater than 0.5. Moreover, it is desirable that (D1)/(D2) ≦0.2. There is no restriction on a dye provided that the solution property is satisfied. However, since water-soluble dyes such as a cationic dye and an anionic dye may have greater environmental variation and electrical resistance of toner may becomes low, thereby deteriorating a transfer rate, it is desirable to use dyes such as a vat dye, a disperse dye, and an oil-soluble dye. The oil-soluble dye is more desirable. Various types of dyes can be used together according to a color tone that is desired. A proportion (weight) of a dye to be used and resin particles can be chosen voluntarily according to the color requirement. Normally, it is desirable to use in a proportion of 1 part by weight to 50 parts by weight of a dye with respect to 1 part by weight of resin particles. For example, if an alcohol such as methanol or ethanol that has a high SP value is used as a coloring solvent and if a styrene-acrylic resin that has an SP value of about 9 is used as resin particles, the following are examples of dyes that can be used.

C. I. SOLVENT YELLOW (6, 9, 17, 31, 35, 1, 102, 103, 105)

C. I. SOLVENT ORANGE (2, 7, 13, 14, 66)

C. I. SOLVENT RED (5, 16, 17, 18, 19, 22, 23, 143, 145, 146, 149, 150, 151, 157, 158)

C. I. SOLVENT VIOLET (31, 32, 33, 37)

C. I. SOLVENT BLUE (22, 63, 78, 83, 84, 85, 86, 91, 94, 95, 104)

C. I. SOLVENT GREEN (2.4×103, 25) and
C. I. SOLVENT BROWN (3, 9) etc.

Dyes available in a market such as AIZEN SOT dyes Yellow—1, 3, 4, Orange—1, 2, 3, Scarlet—1, Red—1, 2, 3, Brown—2, Blue—1, 2, Violet—1, Green—1, 2, 3, Black—1, 4, 6, 8 manufactured by HODOGAYA CHEMICAL CO., LTD.; sudan dyes Yellow—140, 150, Orange—220, Red—290, 380, 460, and Blue—670 manufactured by BASF CO., LTD.; DIAION RESINS, Yellow—3G, F, H2G, HG, HC, HL, Orange—HS, G, Red—GG, S, HS, A, K, H5B, Violet—D, Blue—J, G, N, K, P, H3G, 4G, Green—C, and Brown—A etc. manufactured by MITSUBISHI CHEMICAL CORPORATION; OIL COLOR, Y—3G, GG-S, #105, Orange—PS, PR, #201, Scarlet—#308, Red—5B, Brown—GR, #416, Green—BG, #502, Blue—BOS, HN, Black—HBB, #803, EE, EX, manufactured by ORIENT CHEMICAL INDUSTRIES LTD.; SUMIPLAST Blue—GP, OR, Red—FB, 3B, Yellow—FL 7G, GC manufactured by SUMITOMO CHEMICAL INDUSTRIES; KAYALON, Polyester black EX-SH3, Blue—A-2 of KAYASET Red—B manufactured by NIHON KAYAKU CO., LTD., can be used. However, as dyes are selected in accordance with a combination of resin particles and a solvent used for coloring, the dyes are not restricted to the examples mentioned above.

An organic solvent for coloring that is used for applying a dye on resin particles is a solvent in which the resin particles that are used do not dissolve, or a solvent that causes some swelling. Concretely, a solvent for which a difference in solubility parameter (SP value) is not less than 1.0 is used. It is desirable to use a solvent for which the difference in solubility parameter (SP value) is not less than 2.0. For example, alcohol based compounds such as methanol, ethanol, and n-propanol that have high SP value or n-hexane, n-heptane that have low SP value are used with styrene-acrylic resin particles. If the difference in the SP value is too big, leakage in the resin particles is worsened and the dispersion of resin particles is not good. Therefore, the ideal difference in the SP value is from 2 to 5.

It is desirable to maintain the temperature of the liquid at a temperature not greater than a glass-transition temperature of the resin particles after dispersing the resin particles in the organic solvent in which the dye is dissolved, and stir. This enables to apply color while preventing coagulation of the resin particles. The stirring is to be carried out by using stirrers available in the market such as a homomixer and a magnetic stirrer. The dye can be added directly to slurry that is obtained after completion of polymerization by a method such as the dispersion polymerization method, in other words a dispersion liquid in which the polymerized resin particles are dispersed in the organic solvent, and the mixture can be heated and stirred with the same conditions mentioned above. If the heating temperature exceeds the glass-transition temperature, the resin particles are fused. A method for drying the slurry after coloring is not restricted to any particular method. The slurry may be dried under reduced pressure after filtration or may be dried under reduced pressure directly without separating by filtration. Colored particles that are obtained upon drying in air or drying under pressure after separating by filtration are with almost no coagulation and no loss of the particle size distribution after the resin particles are introduced.

Dissolution Suspension Method

The following is a description of a method of manufacturing spherical toner particles by a dissolution suspension method. According to the dissolution suspension method, an oil phase is prepared by dissolving a resin in a solvent, emulsified in a water phase that includes an aqueous medium and then the solvent in the emulsified-dispersing element is removed to obtain the resin particles.

Only water may be used as an aqueous medium. Water and a solvent that can be mixed may be used as well. Examples of a solvent that can be mixed are alcohols such as methanol, isopropanol, and ethylene glycol, dimethyl formamide, tetrahydrofuran, cellusolves such as methylcellosolve, and lower ketones such as acetone and methyl ethyl ketone.

Examples of resins that can be used are polymers of styrene such as polystyrene, poly p-chlorostyrene, and polyvinyl toluene and polymers of substitutes of styrene; styrene-block copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ketone copolymer, styrene-butadiene copolymer, styrene-isoprene copolymer, styrene-acrylonitrile-indene copolymer, styrene-maleate copolymer, styrene-maleic acid ester copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, modified rosin, turpentine resin, aliphatic or alicyclic hydrocarbon resins, aromatic petroleum resin, chlorinated paraffin, and paraffin wax. These resins can be used independently or upon mixing.

A volatile solvent that has a boiling point less than 100° C. is desirable as a solvent to be used in preparing the oil phase, as it can be removed easily. Examples of the desirable solvent are toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, methylisobutyl ketone, which can be used independently or upon mixing more than one of these. Particularly, aromatic solvents such as toluene and xylene and halogenated hydrocarbons such as methylene chloride, 1,2-dichloroethane, chloroform, and carbon tetrachloride are desirable. An amount of solvent to be used for 100 parts of toner composition is normally from 10 parts to 900 parts.

For preparing of the oil phase, a colorant, (or a master batch of a colorant), a mold releasing agent, and a charge controlling agent which are other elements in the toner composition, may be added simultaneously while forming dispersing element in the aqueous solvent, and mixed. However, it is desirable to mix these in advance in the oil phase.

The colorant, the mold releasing agent, and the charge controlling agent which are other materials in the toner need not be necessarily mixed while forming the particles in the aqueous medium. These may be added after the particles are formed. For example, the colorant can be added by a known coloring method upon formation of the particles that do not include a colorant.

Any mixer that is used normally in which the mixing is carried out by stirring can be used for dispersing the oil phase and the water phase. Among mixers, it is desirable to use a homogenizer that includes a high-speed rotator and a stator, and apart from the homogenizer, a disperser that uses a medium such as a ball mill, bead mill, and a sand mill can be used.

A method of dispersion is not restricted to any particular method. Equipment that uses a method such as a low-speed sheering, high-speed shearing, friction, high-pressure jet, and ultrasonic waves can be used for dispersion. To adjust the particle size of a dispersing element in a range of 2 μm to 20 μm, it is desirable to use the high-speed shearing. An emulsifier that has rotating blades is not restricted to any particular emulsifier. Any emulsifier or disperser that is normally available in the market can be used. Examples of continuous emulsifier are, ULTRA-TURRAX (manufactured by IKA CO., LTD.), POLYTRON (manufactured by KINEMATICA CO., LTD.), T.K. AUTO HOMO MIXER (manufactured by TOKUSHU KIKA KOGYO CO., LTD.), EBARA MILDER (manufactured by EBARA CORPORATION), T.K. PIPELINE HOMO MIXER, T.K. HOMOMIC LINE FLOW (manufactured by TOKUSHU KIKA KOGYOU CO., LTD.), COLLOID MILL (manufactured by SHINKO PANTEC CO., LTD.), SLUDGER, TRIGONAL WET FINE PULVERIZER (manufactured by MITSUI MIIKE CHEMICAL INDUSTRIES), CAVITRON (manufactured by EUROTEC CO.), FINE FLOW MILL (manufactured by PACIFIC MACHINERY & ENGINEERING CO., LTD.), examples of batch emulsifier and both batch and continuous emulsifier are CLEAR MIX (manufactured by M TECHNIQUE CO.) and T.K. FILMICS (manufactured by TOKUSHU KIKA KOGYOU CO., LTD.).

When the high-speed sheering disperser is used, there is no restriction in particular on number of rotations per minute (rpm). However, normally it is used at 100 rpm to 300 rpm, and the desirable range is from 500 rpm to 2000 rpm. There is no restriction in particular on the dispersion time. In a case of the batch dispersion, the normal dispersion time is from 0.1 minute to 5 minutes. The temperature during dispersion is normally in a range of 0° C. to 150° C. (under pressure) and a range of 10° C. to 98° C. is desirable. In a method with high-temperature conditions, the viscosity of the dispersing element becomes low moderately and a point at which the dispersion can be carried out easily is desirable.

In the dissolution dispersion method, a method in which solid fine particles are dispersed in an aqueous medium is used to stabilize the oil phase that is dispersed.

Moreover, other dispersing agents can be used together to adjust adsorption of the solid fine particles dispersing agent into droplets. Dispersing agent other than these can be added to remove the volatile component before or after emulsifying the toner composition.

Solid-particles Dispersing Agent

The solid fine particles dispersing agent is particles in solid form which are not easily soluble in water, existing in the aqueous medium. The solid-particles dispersing agent that has an average fine-particle size in a range of 0.01 μm to 1.00 μm are desirable.

Concrete examples of inorganic fine particles are silica, alumina, titanium oxide, barium titanate, magnesium titanate, calcium titanate, strontium titanate, zinc oxide, tin oxide, quartz sand, clay, mica, wollastonite, diatomaceous earth, chromium oxide, cerium oxide, red ion oxide, antimony trioxide, magnesium oxide, zirconium oxide, barium sulfate, barium carbonate, calcium carbonate, silicon carbonate, and silicon nitride. Desirable examples of inorganic fine particles are calcium phosphate-tribasic, calcium carbonate, colloidal titanium oxide, colloidal silica, and hydroxyapatite. In particular, hydroxyapatite that is synthesized by allowing the sodium phosphate and the calcium chloride in presence of a base, in water, is desirable.

The solid fine particles dispersing agent of organic matter is micro crystals of low-molecular organic compound and high-molecular based fine particles. Examples of the low-molecular organic compound and high-molecular based fine particles are polystyrene, ester methacrylate and ester acrylate copolymer obtained by a polymerization method such as a soap-free emulsified polymerization method, suspension polymerization method, and dispersion polymerization method, polymer particles of silicon, benzoguanamine, and nylon etc. from polycondensed and thermosetting resins.

When a compound that can be dissolved in an alkali such as high polymer fine particles that are copolymerized with acrylic acid that includes a carboxyl group and an acid of a salt such as calcium phosphate, is used as a solid fine particles dispersing agent, the solid fine particles dispersing agent is removed from the toner particles of which the shape is adjusted, by a method such as washing in clear water, after the solid fine particles dispersing agent is dissolved by an acid-base of sodium hydroxide and hydrochloric acid. The solid fine particles dispersing agent can be removed by a process such as dissolving by other enzyme.

Other dispersing agents to be used together during emulsification or to be added afterwards.

Examples of other dispersing agents to be used together during emulsification or to be added afterwards are, anionic surfactants such as alkyl benzene sulfonate, α-olefin sulfonate, and phosphate ester, amine salt type such as alkylamine salt, derivatives of amino alcohol fatty acid, derivatives of polyamine fatty acid, and imidazoline, a cationic surfactant of a quaternary ammonium salt type such as alkyltrimethylammonium salt, dialkyldimethylammonium salt, alkyldimethylbenzene ammonium salt, pyridium salt, alkylisoquinolinium salt, and benzethonium chloride, a nonionic surfactant of derivatives of an fatty acid amide and derivatives of a polyhydric alcohol, and an ampholytic surfactant such as alanine, dodecyl di-(aminoethyl)glycine, di-(octylaminoethyl)glycine, N-alkyl-N, and N-dimethylammonium betaine.

A very small amount can proved to be effective by using a surfactant that includes a fluoroalkyl group. Examples of anionic surfactants that include fluoroalkyl group, which can be used desirably are fluoroalkyl carboxylic acid of carbon numbers from 2 to 10 and its metal salts, disodium perfluorooctane sulfonyl glutamate, sodium 3-[omega-fluoroalkyl (C6~C11) oxy]-1-alkyl (C3~C4) sulfonate, sodium 3-[omega-fluoroalkanyl (C6~C8)-N-ethylamino]-1-propane sulfonate, fluoroalkyl (C11 to C20) carboxylic acid and its metal salts, perfluoroalkyl carboxylic acid (C7 to C13) and its metal salts, perfluoroalkyl (C4 to C12) sulfonic acid and its metal salts, diethanolamide perfluorooctane sulfonate, N-propyl-N-(2 hydroxyethyl) perfluorooctane sulfonamide, perfluoroalkyl (C6 to C10) sulfonamidepropyltrimethylammonium salt, perfluoroalkyl (C6 to C10)-N-ethylsulfonyl glycine salt, and monoperfluoroalkyl (C6 to C16) ethylphosphate ester.

Examples of these products are SURFLON S-111, S-112, and S-113 manufactured by ASAHI GLASS CO., LTD., FLUORAD FC-93, FC-95, FC-98, and FC-129 manufactured by SUMITOMO 3M CO., LTD., UNIDINE DS-101 and DS-102 manufactured by DAIKIN INDUSTRIES, LTD., MEGAFACE F-110, F-120, F-113, F-191, F-813, and F-833 manufactured by DAI NIPPON INK & CHEMICALS, INC., EKTOP EF-102, 103, 104, 105, 112, 123A, 123B, 306A, 501, 201, and 204 manufactured by TOCHEM PRODUCTS CO., LTD., FTERGENT F-100 and F150 manufactured by NEOS CO., LTD.

Examples of the cationic surfactants are aliphatic primary and secondary or secondary amino acids that have a fluoroalkyl group, aliphatic quaternary ammonium salts such as perfluoroalkyl (C6 to C10) sulfonamidepropyltrimethyl ammonium salts, benzalkonium salts, benzethonium chloride, pyridinium salts, and imidazolinium salts. Examples of products are SURFLON S-121 manufactured by ASAHI GLASS CO., LTD., FLUORAD FC-135 manufactured by SUMITOMO 3M CO., LTD., UNIDINE DS-202 manufactured by DAIKIN INDUSTRIES, MEGAFACE F-150, F-82, and 4×103 manufactured by DAI NIPPON INK & CHEMICALS, INC., EKTOP EF-132 manufactured by TOCHEM PRODUCTS CO., LTD., and FTERGENT F-300 manufactured by NEOS CO., LTD.

Stabilization of dispersion droplets may be controlled by high-polymer protective colloid. For example, acids such as acrylic acid, methacrylic acid, α-cyanoacrylic acid, α-cyanomethacrylic acid, itaconic acid, crotonic acid, fumaric acid, maleic acid, and maleic acid anhydride, (meth)acrylic monomers that include a hydroxyl group, which include vinyl alcohol such as β-hydroxy ethylacrylate, β-hydroxy methylacrylate, β-hydroxy propylacrylate, β-hydroxy propylmethacrylate, γ-hydroxy propylacrylate, γ-hydroxy propylmethylacrylate, 3-chloro-2-hydroxy propylacrylate, 3-chloro-2-hydroxy propylmethacrylate, diethylene glycol monoacrylic ester, diethylene glycol monomethacrylic ester, glycerin monoacrylic ester, glycerin monomethacrylic ester, N-methylolacrylamide, N-methylolmethacrylamide, or ethers such as vinylmethylether, vinylethylether, and vinylpropylether with these vinyl alcohols, or esters of compounds that include vinyl alcohol and carboxyl group such as vinyl acetate, vinyl propionate, vinyl butyrate, or acrylamide, methacrylamide, diacetone acrylamide or their methylol compounds, chloride acrylates such as chloride acrylate and chloride methacrylate, compounds such as vinylpyridine, vinylpirolidone, vinylimidazole, and ethyleneimine or homopolymers or copolymers of compounds that include a heterocycle of nitrogen atom, polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester, and celluloses such as methyl cellulose, hydroxyethyl cellulose, and hydroxypropyl cellulose can be used. If dispersing agents are used, the dispersing agents can be let to remain on surface of toner particles. However, from point of view of toner charging, it is desirable to wash and remove the dispersing agents after the reaction.

To remove the organic solvent from the emulsified-dispersing element, a method in which the whole system is heated up gradually and the organic solvent in droplets is removed completely by evaporation can be used. Or a method in which the emulsified-dispersing element is sprayed in a dry atmosphere, then water-insoluble organic solvent in the droplets is removed entirely to form toner fine particles, and aqueous dispersing agent is removed together by evaporation can also be used. As the dry atmosphere in which the emulsified-dispersing agent is sprayed, a heated gas such as air, nitrogen, carbon dioxide, and a combustion gas is used. Normally, any air flow that is heated to a temperature not below a boiling point of a solvent that has the highest boiling point, is used. With a short time treatment by a spray drier, a belt drier, or a rotary kiln, the desired quality can be achieved.

In the dissolution suspension method, the solid fine particles are adhered to surface of oil drops that are normally emulsified and the droplets are stabilized in the spherical shape. However, while the volatile component is being removed, volume of droplets goes on decreasing. Although the volume of the droplets decreases, the solid fine particles are still adhered and remain. Therefore, a decrease in surface area of droplets is slow and cannot keep up with the decrease in the volume. Therefore, the spherical shape cannot be maintained and it results in an indefinite shape.

In the dissolution dispersion, to achieve spherical shaped toner with high degree of circular shape, while the volatile component in the toner is being removed, it is necessary to form particles while maintaining the spherical shape by weakening an adsorptive power at interfaces of solid fine particles and expediting desorption from the droplets. The adsorptive power at the interfaces of the solid fine particles can be weakened by varying charge of the solid fine particles and the surface of droplets. The charge of the solid fine particles and the surface of droplets can be changed by adding surfactant and high-polymer protective colloid, carrying out exchange adsorption, and adjusting pH value of the aqueous medium.

Sphering Treatment of Pulverized Toner

Toner obtained by a method of pulverizing and classifying is indefinite in shape. Depending on the method of pulverizing, the degree of circular shape of this toner is in a range of 0.930 to 0.950, which cannot be in a range of 0.960 to 0.998. However, the degree of circularity can be improved by a mechanical sphering treatment and heating treatment. Thus, toner of the degree of circularity in a range from 0.960 to 0.998 according to the present invention can be obtained.

Mechanical Treatment

For example, by a method disclosed in Japanese Patent Application Laid-open Publication No. 09-085741, in which TURBO MILL (manufactured by TURBO KOGYO CO., LTD.), and by carrying out a continuous treatment by equipments such as CRIPTRON (manufactured by KAWASAKI HEAVY INDUSTRIES LTD.), Q SHAPED MIXER (manufactured by MITSUI MINING CO., LTD.), HYBRIDIZER (manufactured by NARA MACHINERY CO., LTD.), and MECHANOFUSION (manufactured by HOSOKAWA MICRON CO.), the shape of the pulverized toner can be sphered.

Heating Treatment (Dry)

By carrying out semi-fusion of the surface of the toner particles by hot air of temperature from 100° C. to 300° C. by using SURFUSION SYSTEM (manufactured by NIPPON PNEUMATIC MFG. CO., LTD, the shape of the pulverized toner can be sphered.

Heating Treatment (Wet)

By soaking the toner obtained by the method of pulverizing in a high-temperature liquid that has a temperature (about 200° C.) at which the toner has plasticity, the shape of the pulverized toner can be sphered.

Charge Controlling Agent

A charge controlling agent may be included in the toner according to the requirement. Any of the known charge controlling agents can be used. Examples of the charge controlling agent are nigrosin based dyes, triphenylmethane based dyes, chrome contained metal complex dyes, molybdic acid chelate pigments, rhodamine based pigments, alkoxy amines, quaternary ammonium salts (including fluorine modified quaternary ammonium salts), alkyl amides, simple substances or compounds of phosphorus, simple substances or compounds of tungsten, fluorine based activating agents, metal salts of salicylic acid, and metal salts of salicylic acid derivatives etc. The concrete examples are BONTRON 03 as a nigrosin based dye, BONTRON P-51 as a quaternary ammonium salt, BONTRON S-34 as metal content azo pigments, E-82 as an oxynaphtholic acid based metal complex, E-84 as a salicylic acid based metal complex, E-89 as a phenol based condensate (all manufactured by ORIENT CHEMICAL INDUSTRIES, LTD.), TP-302 and TP-415 (manufactured by HODOGAYA CHEMICAL COMPANY, LTD.) as quaternary ammonium salt molybdenum complex, COPY CHARGE PSY VP2038 as a quaternary ammonium salt, COPY BLUE—PR as a derivative of triphenylmethane, and COPY CHARGE NEG VP2036 and COPY CHARGE NX VP434 as quaternary ammonium salt (all manufactured by HOECHST CO., LTD.), LRA-901, LR-147 as a boron complex (manufactured by JAPAN CARLIT CO., LTD.), copper phthalocyanine, perylene, quinacridone, azo based pigments, and apart from this, high polymer compounds having sulfonic group, carboxyl group, and functional groups having quaternary ammonium salt.

For manufacturing the toner particles in the aqueous medium, from the point of view of ionic strength and wastewater pollution, it is desirable to use a charge controlling agent that is not dissolved easily in water.

An amount of the charge controlling agent is determined by a type of a binder resin that is used, presence or absence of any additive used according to need, and a method of manufacturing of toner. The amount of the charge controlling agent is not restricted to a fixed amount. The desirable amount is in a range of 0.1 parts by weight to 10 parts by weight per 100 parts by weight of the binder resin. The more desirable range is from 0.2 parts by weight to 5 parts by weight. If the amount is more than 10 parts by weight, there is an excessive charging of the toner and this deteriorates the effect of the main charge controlling agent. Moreover, the electrostatic absorption force of a developing roller increases, thereby affecting the fluidity of a developer and an image density. These charge controlling agents and the mold releasing agents can be melted and kneaded with the master batch and resins, as well as may be added in the organic solvent during dissolving and dispersion.

Colorant

All known dyes and pigments can be used as a colorant. For example, carbon black, nigrosin dye, iron black, naphthol yellow S, hanza yellow (10G, 5G, and G), cadmium yellow, yellow ion oxide, ocher, chrome yellow, titan yellow, polyazo yellow, oil yellow, hanza yellow (GR, A, RN, and R), pigment yellow L, benzidine yellow (G and GR), permanent yellow (NCG), vulcun fast yellow (5G and R), tartrazine lake, quinoline yellow lake, anthrazan yellow BGL, isoindolinone yellow, bengala (Indian red), red lead (minium), vermilion lead, cadmium red, cadmium mercury red, antimony red, permanent red 4R, para red, fire red, p-chloro o-nitro aniline red, lithol fast scarlet G, brilliant fast scarlet, brilliant carmine BS, permanent red (F2R, F4R, FRL, FRLL, F4RH), fast scarlet VD, vulcun fast rubin B, brilliant scarlet G, lithol rubin GX, permanent red F5R, brilliant carmine 6B, pigment scarlet 3B, bordeaux 3B, bordeaux 5B, toluedine maroon, permanent bordeaux F2K, helio bordeaux BL, bordeaux 10B, bon maroon light, bon maroon medium, eosin lake, rhodamine lake B, rhodamine lake Y, alizarine lake, thioindigo red, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine blue, prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green lake, phthalocyanine green, anthraquinone green, titanium oxide, chinese white (zinc oxide), lithopone, and mixtures of these can be used as pigments and dyes. Amount to be used is normally from 0.1 parts by weight to 50 parts by weight that of the 100 parts by weight of the binder resin.

The colorant can also be used as a master batch complexed with a resin. Examples of a binder resin to be kneaded with the master batch or used in preparation of the master batch, apart from modified and non-modified polyester resins, are, styrenes like polystyrene, poly p-chlorostyrene, and polyvinyl toluene, as well as polymers of their substitutes; styrene-block copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate, styrene-acrylonitrile copolymer, styrene-vinylmethyl ketone copolymer, styrene butadiene copolymer, styrene-isoprene copolymer, styrene-acrylonitrile-indene copolymer, styrene-maleate copolymer, styrene-maleic acid ester copolymer, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, modified rosin, turpentine resin, aliphatic or alicyclic hydrocarbon resin, aromatic petroleum resin, chlorinated paraffin, and paraffin wax. These resins can be used independently or upon mixing.

The master batch can be prepared by mixing and kneading the colorant and the resin for the master batch by applying high-shearing force. While preparing the master batch, an organic solvent can be used to improve interaction between the colorant and the resin. Moreover, a method called as a flushing method can be used to remove water and organic solvent component. In this method, an aqueous paste containing water of the colorant is mixed and kneaded with the resin and the organic solvent. The colorant is shifted towards the resin side and the water and the organic solvent component are removed. This method is used desirably because there is no need to carry out drying as a wet cake of the colorant can be used as it is. A high shearing dispersing device such as three-roll mill is used desirably for mixing and kneading.

Mold Releasing Agent

Examples of wax are solid paraffin wax, microcrystalline wax, rice wax, fatty acid amide wax, fatty acid wax, aliphatic monoketones, fatty acid metal chloride wax, fatty acid ester wax, partly saponified fatty acid ester wax, silicone varnish, higher alcohols, and carnauba wax. Polyolefines such as low-molecular weight polyethylene and polypropylene can be used as well. Melting point of these waxes is in a range of 40° C. to 120° C. It is desirable to use a wax that has a melting point in a range of 50° C. to 100° C. If the melting point of the wax is too high, fixing at a low temperature is not sufficient, whereas if the melting point is too low, there may be a decline in the offset resistance and the durability. The melting point of the wax can be measured by a differential scanning calorimetry (DSC). A sample of few milligrams is heated at a certain programming rate, for example 10° C./min and a melting-peak value when the sample is heated, is let to be the melting point.

Mixing External Additive

To improve fluidity, shelf life, developing, and transferring, inorganic fine particles such as a fine powder of hydrophobic silica may be added to and mixed further with the toner that is manufactured.

A normal mixer for fine particles is used for mixing the additive. It is desirable to provide a jacket and to make an arrangement to control temperature inside. To change hysterisis of load that is imparted to the additive, the additive may be added in-between or gradually. Factors such as number of rotations per minute (rpm), rotational velocity, time, and temperature of the mixer may be changed. In the beginning a strong load, then comparatively weak load or vice versa may be imparted.

Examples of mixing equipment that can be used are V-shaped mixer, rocking mixer, Loedige mixer, Nauta mixer, and Henschel mixer etc.

Inorganic Fine Particles that can be Used as Additive

Inorganic fine particles can be used as an external additive to aid fluidity, developing, transferring, cleaning, and charging of the toner. It is desirable that a primary particle size of the inorganic fine particles is in a range of 0.01 μm to 2 μm and a specific surface area according to BET method is in a range of 20 $m^2/g$ to 500 $m^2/g$. It is desirable that a proportion to be used of the organic fine particles is from 0.1 percent by weight to 15 percent by weight of the toner and a range of 0.5 percent by weight to 10 percent by weight is particularly desirable. Concrete examples of inorganic fine particles are silica, alumina, titanium oxide, barium titanate, magnesium titanate, calcium titanate, strontium titanate, zinc oxide, tin oxide, quartz sand, clay, mica, wollastonite, diatomaceous earth, chromium oxide, cerium oxide, red ion oxide, antimony trioxide, magnesium oxide, zirconium oxide, barium sulfate, barium carbonate, calcium carbonate, silicon carbonate, and silicon nitride.

Carrier for Two-component Developer

When a two-component developer is to be used, it may be used upon mixing with a magnetic carrier. It is desirable that a proportion of a content of the carrier in the developer and the toner is from 1 part by weight to 10 parts by weight of the toner for 100 parts by weight of the developer. Conventionally known materials such as iron powder, ferrite powder, magnetite powder, and a magnetic resin carrier of a particle size in a range of 20 μm to 200 μm can be used as the magnetic carrier. Amino resins such as urea-formaldehyde resins, melamine resins, benzoguanamine resins, urea resins, polyamide resins, and epoxy resins can be used as a coating material. Further, polyvinyl resins and polyvinylidene resins such as acrylic resins, polymethyl methacrylate resins, polyacrylonitrile resins, polyvinyl acetate resins, polyvinyl alcohol resins, polyvinyl butyral resins, polystyrene resins may be used. Moreover, polystyrene resins such as styrene acrylic copolymer resins, olefin halide resins such as polyvinyl chloride, polyester resins such as polyethylene terephthalate resins and polybutylene terephthalate resins may also be used. Further, polycarbonate resins, polyethylene resins, polyvinyl fluoride resins, polyvinylidene fluoride resins, polytrifluoroethylene resins, polyhexafluoropropylene resins, copolymers with vinylidene fluoride and acrylic monomers may also be used. Moreover, copolymers with vinylidene fluoride and vinyl fluoride, fluoroterpolymers such as terpolymers with tetrafluoroethylene, vinylidene fluoride, and non-fluorinated monomers, and silicon resins may be used. A conducting powder may also be included in the coating resin according to the requirement. Metal powders, carbon black, titanium oxide, tin oxide, zinc oxide etc. can be used as the conducting powder. A conducting powder that has an average particle size not greater than 1 μm is desirable. If the average particle size is greater than 1 μm, the control of electric resistance becomes difficult.

A one-component magnetic toner or a non-magnetic toner that does not mix with the carrier may also be used.

Method for Measuring Degree of Circular Shape of Toner

It is desirable that toner has a specific shape. If the toner has an average degree of circular-shape less than 0.95 and if the shape is indefinite and too far from the spherical shape, with the same amount adhered of the toner, the toner layer thickness is more and the percentage of void becomes high. This results in a decrease in the thermal conductivity, and the difference in temperature in the toner layer becomes big. For this reason, such a toner is not desirable.

In a method for measuring the shape, a suspension that includes the particles is allowed to pass over an imaging-portion detection band on a plate. A particle image is detected optically by a CCD camera and analyzed. This method of optical detection band is suitable. According to this method, an average degree of circular shape is calculated by dividing a circumference of a circle equivalent to a projection area by circumference of an actual particle. It was revealed that a toner that has a degree of circular shape not less than 0.95 is useful for forming a highly defined reproducible image with proper density. The average degree of circular shape in a range of 0.960 to 0.998 is more desirable. This value can be measured as an average degree of circular shape by using FLOW PARTICLE IMAGE ANALYZER FPIA-200 (manufactured by TOA MEDICAL ELECTRONICS CO., LTD.). According to the concrete method for measuring, 100 to 150 ml of water with solid impurity removed in advance is taken in a vessel. A surfactant, desirably 0.1 ml to 0.5 ml of alkyl benzene sulfonate is added as a dispersing agent and then 0.1 g to 0.5 g of a test portion is added to this mixture. A suspension in which the sample is dispersed is allowed to undergo dispersion treatment by an ultrasonic disperser for about 1 to 3 minutes. Concentration of a dispersing liquid is let to be from 300 particles/μl to 10000 particles/μl and the shape and distribution of the toner is measured by FLOW PARTICLE IMAGE ANALYZER.

Method for Measuring Toner Particle Size

The average particle size and the particle size distribution of a toner were measured by using COULTER MULTISIZER 3 (manufactured by BECKMAN COULTER COMPANY) and a personal computer (manufactured by IBM) in which a special purpose analysis software manufactured by BECKMAN COULTER COMPANY was used to analyze data. A Kd value was set by using standard particles of particle size 10 μm and an aperture current was set by automatic setting. 1% NaCl aqueous solution prepared by using sodium chloride of first grade was used as an electrolyte. ISOTON-II (manufactured by COULTER SCIENTIFIC JAPAN COMPANY) can also be used as an electrolyte. 0.1 ml to 5 ml of a surfactant, desirably alkyl benzene sulfonate was added as a dispersing agent to 100 ml to 150 ml of the electrolyte aqueous solution and 2 mg to 20 mg of a test portion was added to this solution mixture. The electrolyte in which the test portion was suspended was allowed to undergo dispersion in an ultrasonic disperser for 1 minute to 3 minutes. By using a 100 μm aperture tube, sampling of 50,000 particles of toner of size not less than 2 μm was done and a weight average particle size was calculated.

FIRST MODIFIED EXAMPLE

The following is a description of a first modified example of a fixing unit other than the one installed in the color printer according to the first embodiment.

Figure 12:
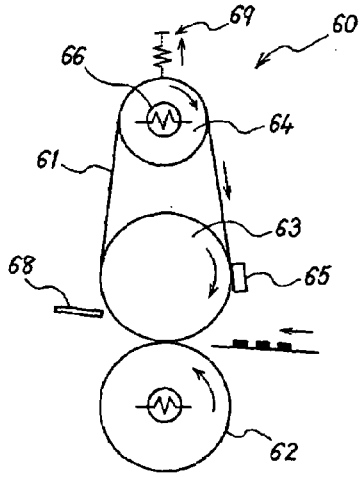
FIG. 12 is a schematic diagram of a fixing unit according to a first modified example.

FIG. 12 is a schematic diagram of a fixing unit 60 according to the first modified example. A structure of a printer is similar to that of the printer according to the first embodiment but a fixing method is different. In other words, in the first embodiment the roller fixing method was used, whereas in the first modified example, belt fixing method is used.

As shown in FIG. 12, an endless fixing belt 61 is put around a back-up roller 63 and a heating roller 64 which carry a recording medium on which toner is to be fixed. The back-up roller 63 and a pressurizing roller 62 are in pressurized contact with each other via the fixing belt 61, and form a fixing nip. Apart from these, the structure includes components such as a thermistor 65 that controls a temperature of the fixing belt 61 and a guide that guides the recording medium on which the toner is to be fixed, towards the fixing nip that is not shown in the diagram. A peeling plate 68 that peels the recording medium from the fixing belt 61 is provided facing a surface of the fixing belt 61 without making a contact with it, on a farther downstream side of the fixing nip in a direction of rotation of the fixing belt 61. According to the first modified example, the fixing belt 61 is stretched over a pair of rollers including the heating roller 64 and the back-up roller 63. However, the fixing belt 61 may be stretched over more than two rollers including other roller.

An endless belt substrate made of a heat-resistant resin or a metal is used as a substrate of the fixing belt 61. A material such as polyimide, polyamide imide, polyether ketone (PEEK) is to be used as a heat-resistant resin and a metal such as nickel, aluminum, and iron is to be used as a material of the metal belt. It is desirable to use a belt of thickness not greater than 100 μm. An outer surface of the fixing belt 61 makes a pressurized contact with the recording paper and a toner image. Therefore, the outer surface of the fixing belt 61 has to have a separating property. Further, it is desirable that the outer surface has an excellent heat resistance and durability. For this reason, a top layer of the fixing belt 61 is coated with a heat-resistant separating layer (fluorine contained resin). The fluorine contained resin is applied by a method such as spraying and is fused by heating to form a surface separating layer. As another structure of the fixing belt 61, an elastic layer such as that of silicone rubber may be provided on a substrate of a heat resistant resin such as polyimide and a conductive separating-layer of a fluorine contained resin (such as PFA tube) may be provided on the elastic layer. It is desirable that the elastic layer of silicone rubber has rubber hardness in a range of 25 to 65 degrees (JIS hardness meter A), thickness in a range of 100 μm to 300 μm to have good fixity and thermal response.

The heating roller 64 is a metal roller made of iron or aluminum with an outer diameter of ϕ20 mm to ϕ30 mm and layer thickness of 0.3 mm to 1.0 mm. The heating roller 64 includes a halogen heater 66 inside. A temperature control element that is not shown in the diagram, controls the temperature to a certain temperature, and heats the fixing belt 61 to a desired temperature. The heating roller 64 also functions as a tension roller and stretches the fixing belt 61 by a tension spring 69 in a direction shown by an arrow in the diagram.

The back-up roller 63 has an outer diameter ϕ50 mm and is provided with an elastic layer that includes materials such as foamed silicone rubber and liquid silicone rubber, which are heat resistant elastic materials to obtain a fixing-nip width around an iron core. Thickness of the elastic layer is about 3.0 mm to 6.0 mm and a surface hardness of the back-up-roller 63 is about 30 Hs to 70 Hs when measured by an Asker C method.

The pressurizing roller 62 includes a core of iron or aluminum with a heat-resistant elastic layer of a material such as a fluorine contained rubber and silicone rubber and a surface separating layer of a material such as a fluorine contained resin. Thickness of the elastic layer of the pressurizing roller 62 is about 0.5 mm to 2.0 mm and surface hardness is in a range of 70 Hs to 90 Hs when measured by the Asker C method. The pressurizing roller 62 may be provided with a heating unit to aid heating by the back-up roller 63. For example, a halogen heater can be provided inside the pressurizing roller 62. The pressurizing roller 62 and the back-up roller 63 are driven by a driving unit that is not shown in the diagram. Moreover, edges of the pressurizing roller 62 are loaded by a unit that is not shown in the diagram. Further, the fixing-nip width is let to be 8.0 mm, a recording speed is let to be 400 mm/s, and the fixing time is set to 0.02 s.

A peeling member 14 is let to be a stainless steel plate of 0.2 mm thickness and a surface of a substrate is coated with a fluorine contained resin layer of thickness 20 μm.

The thermistor 65 is on a farther downstream side of the fixing nip in a direction of rotation of the belt. The thermistor 65 is disposed in a position facing the back-up roller 63 and is in contact with the surface of the fixing belt. The thermistor 65 detects a temperature of the belt surface and is controlled by a controller that is not shown in the diagram to adjust the fixing temperature to a desired temperature. It is easier to control the fixing temperature to a target temperature, in a position near the fixing nip rather than in a position facing the heating roller 64. According to the first modified example, an in-contact temperature detecting element is used as a thermistor. However, a non-contact temperature detecting element that prevents scratches on the belt surface due to contact may also be used.

For the belt fixing method in the first modified example, when the fixing conditions were set similarly as in the first embodiment, the fixing time could be shortened and the energy could be saved while preventing the hot offset. Moreover, the high-speed recording was possible.

SECOND MODIFIED EXAMPLE

The following is a description of a second modified example of a fixing unit other than the one installed in the color printer according to the first embodiment.

Figure 13:
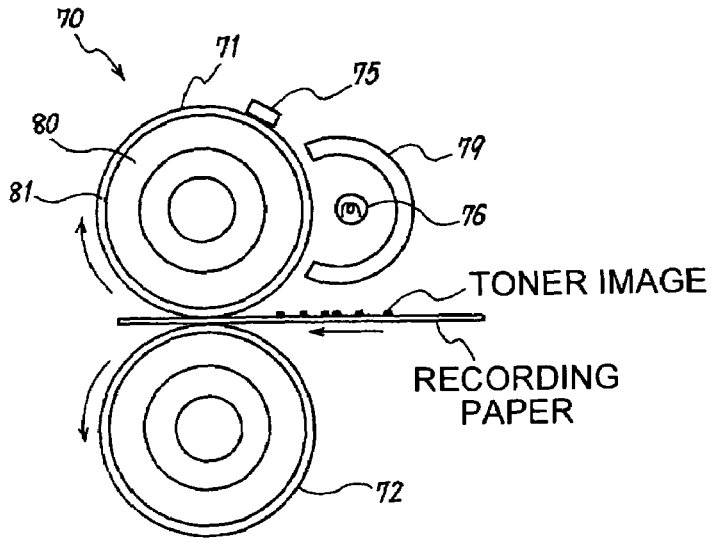
FIG. 13 is a schematic diagram of a fixing unit according to a second modified example.

FIG. 13 is a schematic diagram of a fixing unit 70 according to a second modified example. A structure of a printer is similar to that of the printer according to the first embodiment but a heating method is different.

A fixing roller 71 and a pressurizing roller 72 include a metal core on which an insulating layer 80 is formed by using a material such as hollow fiber as an insulating material. A top layer is formed as a separating layer which is coated by 20 μm thick PFA tube. Halogen heater 76 is provided as a heating unit on an upstream side of a fixing nip from the fixing roller 71. The halogen heater 76 is covered by a reflecting plate 79 to reflect radiant heat towards the fixing roller 71. Such a structure enables the fixing roller 71 to be heated intensively before the fixing nip. With an effect of the insulating layer 80, the thermal conductivity is reduced in a radial direction and a circumferential direction. This enables to control the heat that escapes, to minimum and to expedite the start-up time.

A hardness of the roller can be adjusted by using a layer that includes a material such as silicone rubber as an elastic layer between the insulating layer 80 and the separating layer 81. A hollow fiber of a material such as polyester, polyimide, polyamide imide, polybenzoimidazole, polybenzobisoxazole, polyphenylenesulfide, glass, ceramics, and a metal can be used. Since the insulating effect is improved by a hollow structure, the material of the hollow fiber is not restricted to any particular material. However, in this example, taking into consideration a thermal conductivity and strength of the material, polyimide hollow fiber are used. The polyimide hollow fiber has a structure as shown in FIG. 3 with an outer diameter ϕ230 μm and an inner diameter ϕ150 μm. A percentage of void up to 48% is achieved in gaps inside the hollow fiber and gaps between the hollow fiber turns by winding the hollow fiber closely.

The fixing nip width and the recording speed are let to be such that the heating time is 0.02 s similar to that in the first modified example.

For the belt fixing method in the second modified example, when the fixing conditions were similar to those in the first embodiment, the fixing time could be shortened and the energy could be saved while preventing the hot offset. Moreover, the high-speed recording was possible.

The color printer used in the first embodiment is an example of an apparatus that can be used according to the present invention and the present invention is not restricted to this color printer only. Moreover, conditions to be set of each component and each unit are not restricted to those according to the first embodiment only. According to the second modified example, a halogen heater was used. However, it is not restricted to the halogen heater only and any method such as an electromagnetic induction method, a flash fixing method, and a method in which a resistance heating element is used can be used.

According to the first embodiment, the following conditions from (1) to (3) are satisfied. Therefore, the fixing time can be shortened and the energy can be conserved while preventing the hot offset. Moreover, the high-speed recording is possible.

(1) $2.4\times10^3\ d/(TC\times t)<T_0$, where d is a thickness of toner layer (unit: m), TC is a thermal conductivity of toner [unit: W/mK], and t is fixing time [unit: s].

(2) The temperature of a top layer of toner layer is not greater than a minimum temperature $T_{OFF}$ at which the hot offset of a first fixing member occurs when the fixing time is set to 1 s.

(3) The temperature of a bottom layer of toner that is in contact with an interface of the toner layer and the recording medium is not less than the lower limit temperature $T_{MIN}$ for fixing of the first fixing member when the fixing time is set to 1 s.

Moreover according to the first embodiment, setting is done such that the fixing time is not greater than 0.02 s. This enables to suppress conduction of heat energy to the recording medium and to save energy.

According to the first embodiment, a fixing unit that can be used for fixing a color image in which the thickness of the toner layer has to be made thicker as compared to that in a monochrome image is provided. Therefore, the fixing time can be shortened and the energy can be saved while preventing the hot offset. Moreover, the high-speed recording is possible.

According to the first embodiment, the setting is done such that the toner layer thickness is not greater than 15 μm. Therefore, it is possible to reduce a temperature gradient in the toner layer and to prevent the hot offset, thereby enabling conservation of energy and high-speed recording.

According to the first embodiment, the elastic layer is provided on the heating roller 51. This enables to form an image without unevenness in gloss.

According to the first embodiment, an average load per unit area of the fixing nip is let to be 290 kPa. Therefore, the toner layer tends to become thin during fixing and gaps in the toner layer can be made smaller, thereby improving the thermal conductivity. Therefore, a difference in the temperature in the toner layer becomes smaller and the lower limit temperature for fixing can be reduced. This allows having a tolerance in a temperature range up to minimum temperature $T_{OFF}$ at which the hot offset occurs. Moreover, it is possible to shorten the start-up time and to save energy.

According to the first embodiment, the toner particle size is let to be not bigger than 5 μm. Therefore, an evenness of the image can be maintained even if the toner layer becomes thin. Further, it becomes visually dull for the dotted patch. Moreover, the particles being small, they tend to enter in a space between fibers.

According to the first embodiment, the degree of circular shape of toner is let to be not less than 0.96. Therefore, a packing rate of thinning of the toner layer rises up. Moreover, if a degree of spherical shape is high, the percentage of void becomes low and the thermal conductivity increases. Therefore, it is possible to reduce the difference in temperature in the toner layer and to shorten the fixing time.

According to the first embodiment, the particle size distribution of the toner is at least bipolarized or above. Therefore, there is a rise in the packing rate of the toner. As a result, the percentage of void becomes low and the thermal conductivity can be improved as well as the fixing time can be shortened.

According to the first embodiment, a polymer that includes crystalline polyester is included as toner. Therefore, it is possible to reduce the temperature of the fixing member. This enables to have a tolerance in a temperature range of the minimum temperature $T_{OFF}$ at which the offset occurs and the lower limit temperature $T_{MIN}$ for fixing.

According to the first embodiment, a polymerized toner is used. Therefore, it is possible to achieve easily toner with an excellent degree of circular shape as compared to a pulverized toner. A manufacturing cost of the polymerized toner is low.

According to the first embodiment, a setting is done such that the setting temperature of the heating roller 51 is not greater than 230° C. Therefore, it is possible to prevent deterioration of a fixing member such as the heating roller, due to heat.

The present invention prevents the hot offset and enables to achieve the fixing at a high speed and to save energy.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fixing unit comprising:

a first fixing member that faces a surface of a recording medium on which an unfixed toner layer is held;

a second fixing member that is in a pressurized contact with the first fixing member so as to form a fixing nip theirbetween; and a heating unit that heats the unfixed toner layer from a side of the first fixing member so as to fix the unfixed toner layer on the recording medium, wherein if a difference between a lower limit temperature $T_{MIN}$ for fixing of a surface of the first fixing member that satisfies a fixity and a minimum temperature $T_{OFF}$ of the surface of the first fixing member at which a hot offset occurs at an exit of the fixing nip when a fixing time, in seconds, that is obtained by dividing a width, in meters, of the fixing nip by a velocity, in m/s, of carrying the recording medium through the fixing nip is set to 1 second is let to be $T_0$, following conditions are satisfied:

(1) $2.4\times10^3\times d/(TC\times t)<T_0$, where d is a thickness of the unfixed toner layer in meters, TC is a thermal conductivity of toner in W/mK, and t is the fixing time in seconds, (2) a temperature $T_{top}$ of a topmost layer of the toner layer is not greater than the minimum temperature $T_{OFF}$ at which the hot offset of the surface of the first fixing member occurs when the fixing time is set to 1 seconds, and (3) a temperature $T_{bot}$ of a bottommost layer of the toner layer that is in contact with the recording medium is not less than the lower limit temperature $T_{MIN}$ for fixing of the surface of the first fixing member when the fixing time is set to 1 second.

2. The fixing unit according to claim 1, wherein the fixing time is let to be not greater than 0.02 second.

3. The fixing unit according to claim 1, wherein the recording medium is carried to the fixing nip after superimposing toners of a plurality of colors on the recording medium.

4. The fixing unit according to claim 1, wherein an average thickness of the toner layer at a maximum density before being transported in the fixing nip, is not greater than 15 $\mu$m.

5. The fixing unit according to claim 1, wherein the first fixing member includes an elastic layer.

6. The fixing unit according to claim 1, wherein an average load per unit area of the fixing nip is let to be not less than 290 kPa.

7. The fixing unit according to claim 1, wherein a toner that has an average particle size not bigger than 5 $\mu$m is used.

8. The fixing unit according to claim 1, wherein a degree of circular shape of the toner is not less than 0.96.

9. The fixing unit according to claim 1, wherein a particle size distribution of the toner is bipolarized or above.

10. The fixing unit according to claim 1, wherein the toner includes a crystalline polyester.

11. The fixing unit according to claim 1, wherein a polymerized toner is used.

12. The fixing unit according to claim 1, wherein a control temperature of the surface of the first fixing member is let to be not higher than 230° C.

13. A method of fixing on a recording medium an unfixed toner image that is held on the recording medium by using a fixing unit, wherein the fixing unit includes a first fixing member that faces a surface of a recording medium on which an unfixed toner layer is held;

a second fixing member that is in a pressurized contact with the first fixing member so as to form a fixing nip theirbetween; and a heating unit that heats the unfixed toner layer from a side of the first fixing member so as to fix the unfixed toner layer on the recording medium, wherein if a difference between a lower limit temperature $T_{MIN}$ for fixing of a surface of the first fixing member that satisfies a fixity and a minimum temperature $T_{OFF}$ of the surface of the first fixing member at which a hot offset occurs at an exit of the fixing nip when a fixing time, in seconds, that is obtained by dividing a width, in meters, of the fixing nip by a velocity, in m/s, of carrying the recording medium through the fixing nip is set to 1 second is let to be $T_0$, following conditions are satisfied:

(1) $2.4\times10^3\times d/(TC\times t)<T_0$, where d is a thickness of the unfixed toner layer in meters, TC is a thermal conductivity of toner in W/mK, and t is the fixing time in seconds, (2) a temperature $T_{top}$ of a topmost layer of the toner layer is not greater than the minimum temperature $T_{OFF}$ at which the hot offset of the surface of the first fixing member occurs when the fixing time is set to 1 seconds, and (3) a temperature $T_{bot}$ of a bottommost layer of the toner layer that is in contact with the recording medium is not less than the lower limit temperature $T_{MIN}$ for fixing of the surface of the first fixing member when the fixing time is set to 1 second.

14. An image forming apparatus comprising:

an image carrier that holds a latent image;

a charging unit that charges a surface of the image carrier;

a latent-image forming unit that forms a latent image on the surface of the image carrier that is charged;

a developing unit that develops the latent image with a toner and forms an image;

a transferring unit that transfers the image on a recording medium; and a fixing unit that forms a fixed image by fixing an unfixed toner that is transferred to the recording medium, wherein the fixing unit includes a first fixing member that faces a surface of a recording medium on which an unfixed toner layer is held;

a second fixing member that is in a pressurized contact with the first fixing member so as to form a fixing nip theirbetween; and a heating unit that heats the unfixed toner layer from a side of the first fixing member so as to fix the unfixed toner layer on the recording medium, wherein if a difference between a lower limit temperature $T_{MIN}$ for fixing of a surface of the first fixing member that satisfies a fixity and a minimum temperature $T_{OFF}$ of the surface of the first fixing member at which a hot offset occurs at an exit of the fixing nip when a fixing time, in seconds, that is obtained by dividing a width, in meters, of the fixing nip by a velocity, in m/s, of carrying the recording medium through the fixing nip is set to 1 second is let to be $T_0$, following conditions are satisfied:

(1) $2.4\times10^3\times d/(TC\times t)<T_0$, where d is a thickness of the unfixed toner layer in meters, TC is a thermal conductivity of toner in W/mK, and t is the fixing time in seconds, (2) a temperature $T_{top}$ of a topmost layer of the toner layer is not greater than the minimum temperature $T_{OFF}$ at which the hot offset of the surface of the first fixing member occurs when the fixing time is set to 1 seconds, and (3) a temperature $T_{bot}$ of a bottommost layer of the toner layer that is in contact with the recording medium is not less than the lower limit temperature $T_{MIN}$ for fixing of the surface of the first fixing member when the fixing time is set to 1 second.

* * * * *